US008915194B2

(12) United States Patent
Creighton et al.

(10) Patent No.: US 8,915,194 B2
(45) Date of Patent: Dec. 23, 2014

(54) HOPPER CARS WITH ONE OR MORE DISCHARGE CONTROL SYSTEMS

(75) Inventors: George S. Creighton, Double Oak, TX (US); D. Bruce Fetterman, Arlington, TX (US); Robert J. Barry, Arlington, TX (US)

(73) Assignee: Trinity Industries, Inc., Dallas, TX (US)

( * ) Notice: Subject to any disclaimer, the term of this patent is extended or adjusted under 35 U.S.C. 154(b) by 542 days.

(21) Appl. No.: 12/816,203

(22) Filed: Jun. 15, 2010

(65) Prior Publication Data

US 2010/0275811 A1 Nov. 4, 2010

Related U.S. Application Data

(63) Continuation of application No. 11/550,098, filed on Oct. 17, 2006, now Pat. No. 7,735,426, which is a continuation-in-part of application No. 11/381,687, filed on May 4, 2006, now Pat. No. 7,681,507, which is a continuation of application No. 10/926,370, filed on Aug. 25, 2004, now Pat. No. 7,051,661.

(60) Provisional application No. 60/728,032, filed on Oct. 18, 2005, provisional application No. 60/498,117, filed on Aug. 26, 2003.

(51) Int. Cl.
*B61D 3/00* (2006.01)
*B61D 7/24* (2006.01)

(52) U.S. Cl.
CPC ..... *B61D 7/24* (2013.01)
USPC ..... 105/286

(58) Field of Classification Search
USPC ..... 105/286–288, 290, 280, 247, 248
See application file for complete search history.

(56) References Cited

U.S. PATENT DOCUMENTS

| | | | |
|---|---|---|---|
| 215,625 | A | 5/1879 | Jauriet |
| 686,902 | A | 11/1901 | Müller et al. |
| 707,416 | A | 8/1902 | Hornbrook |
| 728,029 | A | 5/1903 | Shepard |

(Continued)

FOREIGN PATENT DOCUMENTS

GB 7564 0/1910

OTHER PUBLICATIONS

Chinese Office Action with English Translation; Application No. 201010181286.X; pp. 11, Apr. 15, 2011.

(Continued)

*Primary Examiner* — R. J. McCarry, Jr.
(74) *Attorney, Agent, or Firm* — Baker Botts L.L.P.

(57) ABSTRACT

Hopper cars both open and covered and discharge control systems are disclosed. Each hopper car may include at least one hopper and a center sill which defines in part a longitudinal axis of the hopper car. At least one discharge opening may be formed proximate a lower portion of each hopper. A respective door assembly may be pivotally mounted adjacent to each discharge opening to control the flow of lading from the respective discharge opening. Each discharge control system may include a common linkage and associated secondary linkages operable to move associated door assemblies between a first position and a second position. A power source including a motor, an air cylinder or a hydraulic cylinder may be disposed on the railway car to move the common linkage. For other hopper cars a wayside drive system may be releasably engaged with a capstan operable coupled to the common linkage.

27 Claims, 16 Drawing Sheets

(56) References Cited

U.S. PATENT DOCUMENTS

| | | | | | |
|---|---|---|---|---|---|
| 775,402 | A | | 11/1904 | Hitchcock | |
| 971,603 | A | | 10/1910 | Goodwin | |
| 1,076,011 | A | | 10/1913 | Campbell | |
| 1,085,058 | A | | 1/1914 | Messick | |
| 1,092,659 | A | | 4/1914 | Mettler | |
| 1,164,918 | A | | 12/1915 | Campbell | |
| 1,209,809 | A | | 12/1916 | Campbell | |
| 1,212,043 | A | | 1/1917 | Freeman | |
| 1,284,111 | A | | 11/1918 | Kestler | |
| 1,330,361 | A | | 2/1920 | Todd | |
| 1,405,415 | A | | 2/1922 | Hochberg | |
| 1,482,559 | A | | 2/1924 | Hart | |
| 1,494,579 | A | | 5/1924 | Bohn | |
| 1,801,564 | A | | 4/1931 | Muffly | |
| 2,011,155 | A | | 8/1935 | Neikirk | 105/415 |
| 2,047,133 | A | | 7/1936 | Christianson et al. | 105/409 |
| 2,167,362 | A | | 7/1939 | Hindahl | 105/251 |
| 2,169,692 | A | | 8/1939 | Hansen | 292/5 |
| 2,269,631 | A | | 1/1942 | Marinello | 105/377 |
| 2,605,064 | A | | 7/1952 | Davis | 244/118 |
| 2,684,642 | A | | 7/1954 | Dorey | 105/251 |
| 2,716,383 | A | | 8/1955 | Johnson | 105/369 |
| 2,756,693 | A | | 7/1956 | Frost | 105/369 |
| 2,888,883 | A | | 6/1959 | Fritz et al. | 105/250 |
| 3,137,247 | A | | 6/1964 | Hamilton et al. | 105/251 |
| 3,179,068 | A | | 4/1965 | Jensen | 105/369 |
| 3,288,531 | A | | 11/1966 | Bartsch | 298/23 |
| 3,316,858 | A | | 5/1967 | Fritz | 105/241 |
| 3,343,725 | A | | 9/1967 | Cannon | 222/129 |
| 3,408,956 | A | | 11/1968 | Rebenok et al. | 105/240 |
| 3,434,433 | A | | 3/1969 | Floehr | 105/249 |
| 3,447,485 | A | | 6/1969 | Dorey | 105/251 |
| 3,455,253 | A | | 7/1969 | Floehr | 105/251 |
| 3,468,062 | A | | 9/1969 | Custer | 49/362 |
| 3,468,063 | A | | 9/1969 | Hennessy | 49/362 |
| 3,501,030 | A | | 3/1970 | Flink | 214/17 |
| 3,581,672 | A | * | 6/1971 | Aquino | 105/240 |
| 3,601,453 | A | | 8/1971 | Silverman | 303/89 |
| 3,610,485 | A | | 10/1971 | Van Raden | 222/564 |
| 3,624,761 | A | | 11/1971 | Kohn | 180/112 |
| 3,626,865 | A | | 12/1971 | Aquino et al. | 105/240 |
| 3,636,658 | A | | 1/1972 | Bollinger, Sr. | 49/362 |
| 3,656,437 | A | | 4/1972 | Kuzmicki | 105/240 |
| 3,683,552 | A | | 8/1972 | Bollinger, Sr. | 49/209 |
| 3,730,360 | A | | 5/1973 | Aquino et al. | 214/63 |
| 3,746,388 | A | | 7/1973 | Robinson | 296/28 M |
| 3,762,341 | A | | 10/1973 | Adler | 105/376 |
| 3,789,772 | A | | 2/1974 | Bullard | 105/240 |
| 3,796,007 | A | | 3/1974 | Bollinger, Sr. et al. | 49/362 |
| 3,800,711 | A | | 4/1974 | Tuttle | 105/251 |
| 3,802,356 | A | | 4/1974 | Hassellof et al. | 105/376 |
| 3,837,296 | A | | 9/1974 | Loomis | 105/376 |
| 3,843,081 | A | | 10/1974 | Meier et al. | 248/223 |
| 3,851,672 | A | | 12/1974 | De Vincent et al. | 138/106 |
| 3,883,992 | A | | 5/1975 | Bollinger, Sr. | 49/362 |
| 3,917,338 | A | | 11/1975 | Becker | 296/28 M |
| 3,923,327 | A | | 12/1975 | Ross, Jr. | 292/39 |
| 3,949,681 | A | | 4/1976 | Miller | 105/284 |
| 3,965,760 | A | | 6/1976 | Etheredge, Jr. | 74/89.14 |
| 3,990,184 | A | | 11/1976 | Bollinger, Sr. | 49/218 |
| 3,996,591 | A | | 12/1976 | Hayward | 343/225 |
| 4,021,066 | A | | 5/1977 | McShane | 292/144 |
| 4,112,852 | A | | 9/1978 | Koranda | 105/282 A |
| 4,114,318 | A | | 9/1978 | Brindle | 49/215 |
| 4,136,621 | A | | 1/1979 | Schuller et al. | 105/308 E |
| 4,138,948 | A | | 2/1979 | Korolis | 105/251 |
| 4,145,080 | A | | 3/1979 | Miller et al. | 296/183 |
| 4,167,144 | A | | 9/1979 | Martin et al. | 105/467 |
| 4,168,667 | A | | 9/1979 | Loomis | 105/467 |
| 4,224,877 | A | * | 9/1980 | Stark et al. | 105/250 |
| 4,227,732 | A | | 10/1980 | Kish | 294/71 |
| 4,235,169 | A | | 11/1980 | Peterson | 105/251 |
| 4,246,849 | A | | 1/1981 | Gramse | 105/251 |
| 4,250,814 | A | | 2/1981 | Stark et al. | 105/251 |
| 4,262,601 | A | | 4/1981 | Miller | 105/241.2 |
| 4,342,267 | A | | 8/1982 | Blout | 105/282 P |
| 4,400,914 | A | | 8/1983 | Hennessy | 49/362 |
| 4,417,526 | A | | 11/1983 | Marulic et al. | 105/406 R |
| 4,444,539 | A | | 4/1984 | Muhoray | 414/360 |
| 4,450,773 | A | | 5/1984 | Fritz et al. | 105/282 A |
| 4,491,354 | A | | 1/1985 | Williams | 292/148 |
| 4,580,502 | A | | 4/1986 | Ritzl et al. | 105/240 |
| 4,601,244 | A | | 7/1986 | Fischer | 105/240 |
| 4,604,023 | A | | 8/1986 | Musschoot | 414/375 |
| 4,655,401 | A | | 4/1987 | Binzen et al. | 241/69 |
| 4,754,710 | A | | 7/1988 | Kieres | 105/355 |
| 4,766,820 | A | | 8/1988 | Ritter et al. | 105/240 |
| 4,829,908 | A | | 5/1989 | Hallam | 105/240 |
| 4,930,427 | A | | 6/1990 | Ritter et al. | 105/406.1 |
| 4,986,590 | A | | 1/1991 | Patti et al. | 296/39.2 |
| 5,077,459 | A | | 12/1991 | Heumiller | 219/117.1 |
| 5,115,748 | A | | 5/1992 | Westlake | 105/286 |
| 5,144,895 | A | | 9/1992 | Murray | 105/286 |
| 5,163,372 | A | | 11/1992 | Galvan et al. | 105/240 |
| 5,177,988 | A | | 1/1993 | Bushnell | 70/279 |
| 5,197,845 | A | | 3/1993 | Snead | 414/339 |
| 5,261,333 | A | * | 11/1993 | Miller | 105/287 |
| 5,263,422 | A | | 11/1993 | Barefoot | 105/308.1 |
| 5,351,582 | A | | 10/1994 | Snyder et al. | 81/57.17 |
| 5,562,989 | A | | 10/1996 | Statz | 428/402 |
| 5,613,446 | A | | 3/1997 | DiLuigi et al. | 105/282.2 |
| 5,713,974 | A | | 2/1998 | Martin et al. | 65/17.2 |
| 5,765,485 | A | | 6/1998 | Thoman et al. | 105/404 |
| 5,802,984 | A | | 9/1998 | Thoman et al. | 105/404 |
| 5,868,045 | A | | 2/1999 | Hauk | 81/57.34 |
| 5,890,435 | A | | 4/1999 | Thoman et al. | 105/404 |
| 6,019,049 | A | | 2/2000 | Gaydos et al. | 105/289 |
| 6,067,912 | A | | 5/2000 | Miller | 105/283 |
| 6,092,472 | A | | 7/2000 | Thoman et al. | 105/404 |
| 6,109,844 | A | | 8/2000 | Nadherny et al. | 410/34 |
| 6,112,671 | A | | 9/2000 | Basile et al. | 105/422 |
| 6,116,118 | A | | 9/2000 | Wesch, Jr. | 81/57.34 |
| 6,138,529 | A | | 10/2000 | Pietras | 81/57.33 |
| 6,138,580 | A | | 10/2000 | Thoman | 105/396 |
| 6,186,563 | B1 | | 2/2001 | Kruzick et al. | 292/201 |
| 6,213,028 | B1 | | 4/2001 | Fetterman et al. | 105/247 |
| 6,257,150 | B1 | | 7/2001 | Burke | 105/247 |
| 6,270,600 | B1 | | 8/2001 | Wycech | 156/79 |
| 6,279,487 | B1 | | 8/2001 | Gaydos et al. | 105/289 |
| 6,286,437 | B1 | | 9/2001 | Lucas | 105/282.3 |
| 6,315,509 | B1 | | 11/2001 | Nadherny et al. | 410/116 |
| 6,367,391 | B1 | | 4/2002 | Thoman et al. | 105/404 |
| 6,374,546 | B1 | | 4/2002 | Fecko et al. | 52/17 |
| 6,402,446 | B1 | | 6/2002 | Nadherny et al. | 410/100 |
| 6,422,794 | B1 | | 7/2002 | Zhan et al. | 410/100 |
| 6,450,105 | B1 | | 9/2002 | Glass | 105/404 |
| 6,481,941 | B2 | | 11/2002 | Nadherny et al. | 410/114 |
| 6,494,651 | B1 | | 12/2002 | Zhan et al. | 410/116 |
| 6,571,718 | B2 | | 6/2003 | Lucas | 105/282.3 |
| 6,575,102 | B2 | | 6/2003 | Norton et al. | 105/423 |
| 6,585,466 | B2 | | 7/2003 | Zhan et al. | 410/116 |
| 6,609,583 | B2 | | 8/2003 | Schillaci et al. | 180/69.21 |
| 6,615,741 | B2 | | 9/2003 | Fecko et al. | 105/404 |
| 6,626,623 | B2 | | 9/2003 | DeLay | 410/116 |
| 6,655,886 | B2 | | 12/2003 | Grandy | 410/112 |
| 6,668,730 | B2 | | 12/2003 | Goldbeck | 104/162 |
| 6,709,209 | B2 | | 3/2004 | Zhan et al. | 410/116 |
| 6,712,568 | B2 | | 3/2004 | Snyder et al. | 410/104 |
| 6,722,287 | B2 | | 4/2004 | Norton et al. | 105/404 |
| 6,748,841 | B1 | | 6/2004 | Fritz | 87/57.41 |
| 6,761,840 | B2 | | 7/2004 | Fecko et al. | 264/31 |
| 6,835,041 | B1 | | 12/2004 | Albert | 414/386 |
| 6,955,126 | B2 | | 10/2005 | Taylor | 105/250 |
| 6,955,127 | B2 | | 10/2005 | Taylor | 105/299 |
| 7,051,661 | B2 | | 5/2006 | Herzog et al. | 105/286 |
| 7,080,599 | B2 | | 7/2006 | Taylor | 105/290 |
| 2004/0112181 | A1 | | 6/2004 | Fritz | 81/57.41 |

OTHER PUBLICATIONS

*Equipment Diagram for Unrestricted Interchange Service Standard*; Association of American Railroads Mechanical Division; Plate F; 1 page, Apr. 1, 1976.

(56) References Cited

OTHER PUBLICATIONS

Del Vecchio, et al.; *Center Flow; The Most Common Car in Railroading Cam From American Car & Foundry*; 60, 2; Research Library; pp. 42-47, Feb. 2000.
*IRECO; Boxcar Lading Tie Anchor*; http://www.ireco.com/BoxcarLadingAnchors2761_3648.htm; 2 pages, Dec. 15, 2003.
*Energy Storage Technologies; What is Vacuum Insulation?*; http://estglobal.com/tech-vin.html; 2 pages, Oct. 5, 2004.
PCT Notification of Transmittal of the International Search Report and the Written Opinion of the International Searching Authority for International Application No. PCT/US2004/027519; 14 pages, Nov. 30, 2004.
PCT Invitation to Pay Additional Fees for International Application No. PCT/US2004/027508; 6 pages, Dec. 6, 2004.
PCT Notification of Transmittal of the International Search Report and the Written Opinion of the International Searching Authority for International Application No. PCT/US2004/027508; 19 pages, Feb. 16, 2005.
Office Action for U.S. Appl. No. 10/926,370 in the name of John C. Herzog; 7 pages, Jun. 24, 2005.
Office Action for U.S. Appl. No. 10/926,381 in the name of George S. Creighton; 6 pages, Jul. 25, 2005.
Office Action for U.S. Appl. No. 10/926,370 in the name of John C. Herzog; 6 pages, Nov. 22, 2005.
Notice of Allowance and Fee(s) Due for U.S. Appl. No. 10/926,370 in the name of John C. Herzog; 7 pages, Jan. 20, 2006.
PCT Notification Concerning Transmittal of International Preliminary Report on Patentability (Chapter I of the Patent Cooperation Treaty) for International Application No. PCT/US2004/027508; 12 pages, Mar. 9, 2006.
PCT Notification Concerning Transmittal of International Preliminary Report on Patentability (Chapter I of the Patent Cooperation Treaty) for International Application No. PCT/US2004/027519; 8 pages, Mar. 9, 2006.
Office Action for U.S. Appl. No. 11/381,687 in the name of John C. Herzog; 6 pages, Aug. 29, 2006.
Office Action for U.S. Appl. No. 11/381,687 in the name of John C. Herzog; 6 pages, Mar. 13, 2007.
Office Action for U.S. Appl. No. 11/381,687 in the name of John C. Herzog; 5 pages, Aug. 9, 2007.
State Intellectual Property Office of the People's Republic of China; The First Office Action for Application No. 200480024606.3; 7 pages, Nov. 2, 2007.
Office Action in Ex Parte Reexamination for U.S. Appl. No. 90/008,453 in the name of John C. Herzog; 12 pages, Nov. 19, 2007.
Office Action in Ex Parte Reexamination for U.S. Appl. No. 90/008,461 in the name of George S. Creighton; 15 pages, Nov. 19, 2007.
Moscow Letter of Inquiry for Application No. 2006105341/11(005772); 9 pages, Jan. 17, 2008.
Office Action for U.S. Appl. No. 11/381,687 in the name of John C. Herzog; 7 pages, Jan. 25, 2008.
State Intellectual Property Office of the People's Republic of China; The First Office Action for Application No. 200480024605.9; 8 pages, Feb. 1, 2008.
Advisory Action for U.S. Appl. No. 11/381,687 in the name of John C. Herzog; 3 pagep, May 12, 2008.
The Patent Office of the People's Republic of China; The Second Office Action for Application No. 200480024605.9; 4 pages, Jul. 18, 2008.
Office Action for U.S. Appl. No. 11/381,687 in the name of John C. Herzog; 5 pages, Sep. 30, 2008.
Office Action for U.S. Appl. No. 11/381,687 in the name of John C. Herzog; 7 pages, Apr. 16, 2009.
The Patent Office of the People's Republic of China; Rejection Decision for Application No. 200480024605.9; 8 pages, Apr. 17, 2009.
The Patent Office of the People's Republic of China; Rejection Decision for Application No. 200480024606.3; 14 pages, May 15, 2009.
Notice of Allowance and Fee(s) Due for U.S. Appl. No. 11/381,687 in the name of John C. Herzog; 4 pages, Jul. 6, 2009.
Office Action for U.S. Appl. No. 12/138,146 in the name of John C. Herzog; 6 pages, Aug. 4, 2009.
IP Australia; Examiner's First Report for Application No. 2004268995; 2 pages, Sep. 14, 2009.
Office Action for U.S. Appl. No. 11/550,098 in the name of George S. Creighton; 7 pages, Sep. 15, 2009.
IP Australia; Examiner's First Report for Application No. 2004268992; 2 pages, Sep. 22, 2009.
Notice of Allowance and Fee(s) Due for U.S. Appl. No. 11/381,687 in the name of John C. Herzog; 4 pages, Nov. 3, 2009.
Notice of Allowance and Fee(s) Due for U.S. Appl. No. 11/550,098 in the name of George S. Creighton; 4 pages, Feb. 1, 2010.
Office Action for U.S. Appl. No. 12/138,146 in the name of John C. Herzog; 7 pages, Feb. 22, 2010.
Canadian Intellectual Property Office; Office Action for Application No. 2,534,146; 2 pages, May 11, 2010.
Notice of Allowance and Fee(s) Due for U.S. Appl. No. 12/138,146 in the name of John C. Herzog; 7 pages, Jun. 1, 2010.

* cited by examiner

HOPPER CARS WITH ONE OR MORE DISCHARGE CONTROL SYSTEMS

RELATED APPLICATIONS

This application is a continuation of U.S. patent application Ser. No. 11/550,098 entitled "Hopper Cars with One or More Discharge Control Systems" filed Oct. 17, 2006, now U.S. Pat. No. 7,735,426, which claims the benefit of U.S. Provisional patent application Ser. No. 60/728,032 filed Oct. 18, 2005 entitled "Hopper Cars with One or More Discharge Control Systems". U.S. patent application Ser. No. 11/550,098 is a continuation-in-part application of U.S. patent application Ser. No. 11,381,687 entitled "Railcar with Discharge Control System" filed May 4, 2006, which is a continuation of U.S. application Ser. No. 10/926,370 entitled "Railcar with Discharge Control System" filed Aug. 25, 2004, now U.S. Pat. No. 7,051,661, which claims the benefit of U.S. Provisional Patent Application Ser. No. 60/498,117 filed Aug. 26, 2003, the contents of which are incorporated herein by reference in their entirety.

This application is related to copending Continuation-in-Part application Ser. No. 11/548,492, filed Oct. 11, 2006 entitled "Over Center Lock Indicator for Railway Car Door Operation Mechanism" which is a Continuation-In-Part Application from U.S. application Ser. No. 11/182,975 filed Jul. 15, 2005 entitled "Safety Latch Lock Indicator For Railcar Door Operation Mechanism," which claims the benefit of U.S. Provisional Patent Application Ser. No. 60/600,290 filed Aug. 10, 2004.

This application is related to copending Application Ser. No. 10/926,381 filed Aug. 25, 2004 entitled "Railway Hopper Car with Longitudinal Discharge Openings," which claims the benefit of U.S. Provisional Patent Application Ser. No. 60/498,105 filed Aug. 26, 2003.

TECHNICAL FIELD

The disclosure is related in general to railway cars and more particularly to hopper cars which discharge cargo or lading, such as coal, ore, aggregate, ballast, grain and other bulk lading through one or more openings in a hopper.

BACKGROUND OF THE DISCLOSURE

Railway cars with one or more hoppers have been used for many years to transport and sometimes store dry, bulk commodities and materials. Hopper cars are frequently used to transport coal, sand, metal ores, ballast, aggregates, grain and any other type of lading which may be satisfactorily discharged through respective openings formed in one or more hoppers. Respective discharge openings are often provided at or near the bottom of each hopper to rapidly discharge cargo. A variety of door assemblies and gate assemblies along with various operating mechanisms have been used to open and close discharge openings associated with railway cars.

Hopper cars may be classified as open or closed. Hopper cars may have relatively short sidewalls and end walls or relatively tall or high sidewalls and end walls. The sidewalls and end walls of many hopper cars are typically reinforced with a plurality of vertical side stakes. The sidewalls and end walls are typically formed from steel or aluminum sheets. Some hopper cars include interior frame structures or braces to provide additional support for the sidewalls. Hopper cars may be generally described as top loading and bottom unloading. Such hopper cars typically require closing gates or doors located underneath the hopper car prior to loading and opening the gates or doors only when the hopper car is at a specific location in an unloading facility. Through use of linkages and one or more power sources such as an air cylinder, a hydraulic cylinder, an electrical motor, capstan drive system or other types of operating mechanisms associated with hopper cars the gates or doors may be closed prior to loading and opened to discharge lading.

A wide variety of techniques and methods have been used for loading and unloading bulk materials from railway cars. For example, bottom dumping hopper cars are often equipped with discharge doors or gates that may be opened as each railway car moves over a pit or an elevated trestle. Various techniques may be used to open discharge doors or gates while the railway car continues to move. Such facilities often include a feeder and a conveyor to move coal or other bulk materials after dumping.

Another technique involves use of a rotary power dumper. Such facilities are frequently used for unloading coal at coal fired electrical power plants.

Side dumping cars have also been used for many years. Side dumping cars typically require an elevated track on a built-up embankment so that the dumped lading will flow over the side of the embankment and not flow back over the tracks on which the cars are moving.

Coal is often shipped in unit trains pulled by several high horse power locomotives. These trains may include over one hundred cars with each car carrying about 100-115 tons of coal. Rotary dump coal cars are often used with such unit trains. Rotary dump coal cars are generally equipped with swiveling or rotary couplers. An unloading facility used with such coal cars generally includes a rotary dumper and an indexing system to properly position each car in the rotary dumper. The rotary dumper may respectively engage each car and a special section of track and rotate both the car and the section of track as a single unit relative to a longitudinal axis extending through rotary couplers of adjacent cars. A rotary power dumper or rotary car dumper typically engages a loaded car, rotates the car through three hundred sixty degrees (360°) and returns the empty car and associated section of track to the original starting position without uncoupling from adjacent cars. Rotary dump unloading facilities are expensive to build and expensive to maintain.

Large quantities of coal and other types of bulk lading are often shipped in open top, bottom dump hopper cars. Because these cars are emptied by dumping from the bottom, unloading equipment and facilities are often located beneath associated tracks to receive the dumped coal or other bulk lading. Sometimes, these facilities include large, rail-supporting I beams suspended over permanent steel hoppers mounted in thick, high strength concrete foundations located beneath elevated railroad tracks. Unloading techniques may include dumping coal in large, relatively long piles under the elevated tracks.

Even though large quantities of bulk commodities may be transported at low costs from one terminal to another, each unloading facility must also maintain favorable economics of railcar transportation for purchases of bulk commodities. If unloading is slow, each train may be delayed for a substantial period of time adding cost per ton for the associated bulk commodities.

SUMMARY OF THE DISCLOSURE

In accordance with teachings of the disclosure, several disadvantages and problems associated with railway cars and discharge control systems associated with transporting bulk materials and bulk commodities may be substantially reduced or eliminated.

Discharge control systems incorporating teachings of the disclosure may be used to open discharge doors or gates which extend either laterally or longitudinally relative to the center sill of an associated railway car. For some applications rotational movement of a threaded rod may be translated into linear movement of a primary linkage. Such movement of the primary linkage may be translated by one or more secondary linkages into movement of associated discharge doors between respective open and closed positions. Some railway cars incorporating teachings of the disclosure may have two hoppers and two independent discharge control systems operable to open and close respective pairs of discharge doors for each hopper. A power source or drive actuator such as an air or pneumatic cylinder, electric motor, air motor, hydraulic cylinder or capstan drive mechanism may be provided to move a common linkage to open and close associated discharge doors located proximate a center sill of a railway car.

Discharge control systems incorporating teachings of the disclosure may provide increased mechanical advantage which may allow a relatively small, high speed low torque motor to move a common linkage, associated secondary linkages and discharge doors between their open and closed positions. For some embodiments the common linkage may extend generally parallel with an associated center sill. For other embodiments the common linkage may extend generally perpendicular to an associated center sill. The discharge control system may include over center locking and simplified mechanical adjustments as compared with many prior discharge control systems and operating assemblies for discharge doors and gates.

One embodiment may include a railway car having two or more hoppers for transporting lading and respective discharge control systems for each hopper. The railway car may include an underframe having a center sill that defines in part a longitudinal axis of the railway car with at least one discharge opening formed proximate a lower portion of each hopper. A respective door assembly or gate assembly may be mounted adjacent to each discharge opening to control the flow of lading from the associated hopper. Each discharge control system may be used to move respective door assemblies between a first, closed position and a second, open position. A respective power source such as an air or pneumatic cylinder, hydraulic cylinder, hydraulic motor, air motor, electrical motor or capstan drive mechanism may be used to move each common linkage. Torque limiters such as friction clutches, slip-type clutches, ball detent mechanisms and shear pins may be used with some capstan drive mechanisms in accordance with teachings of the disclosure.

Another embodiment may include a railway car having at least one hopper and associated discharge openings formed adjacent to a lower portion or bottom of each hopper. Such railway cars may be efficiently and economically used to transport and unload bulk materials or bulk commodities such as coal at a wide variety of facilities. For example, such railway cars may be satisfactorily used to unload coal at facilities with elevated tracks and bulk commodity handling equipment designed for use with bottom dump hopper cars. Such railway cars may also be satisfactorily used at rotary dump facilities without requiring the use of an associated rotary power dumper.

Railway cars incorporating teachings of the disclosure may significantly extend the useful life of rotary dump facilities without requiring repair and/or replacement of associated rotary power dumpers. Such railway cars may be economically and efficiently used with two of the most common types of coal unloading facilities, bottom dump facilities and rotary dump facilities. As a result an owner of both bottom dump and rotary dump facilities may save substantial amounts of money by purchasing train sets of hopper cars incorporating teachings of the disclosure which may be satisfactorily used at both types of facilities.

For some applications each longitudinal discharge opening may be disposed between rails or tracks on which the railway car moves. Associated longitudinal doors and bottom slope sheets may cooperate with each other to direct lading discharged from a hopper to flow between such rails or tracks. A discharge control system incorporating teachings of the disclosure may open associated door assemblies to allow discharge of lading between the rails or tracks when the associated railway car is stationary or when the associated railway car is moving as appropriate for each type of unloading facility.

For some applications a unit train having railway cars with bottom slope sheets, longitudinal discharge openings and a discharge control system incorporating teachings of the disclosure may be unloaded at a rotary dump facility in substantially less than a unit train carrying the same amount of coal in rotary dump cars. The length of time required to unload a unit train with rotary dump cars is often long enough to require at least one crew change during the rotary dump unloading process. A crew may be able to stay on a unit train having railway cars incorporating teachings of the disclosure during the complete unloading process at the same rotary dump facility which reduce costs as compared to unloading a unit train with all rotary dump cars.

Another embodiment may include an articulated railway car having two or more car bodies. For example, a first hopper car and a second hopper car may be mounted on three articulated railway car trucks. A discharge control system formed in accordance with teachings of the disclosure may be satisfactorily used to control opening and closing of doors or gates associated with each car body of the articulated railway car.

BRIEF DESCRIPTION OF THE DRAWINGS

For a more complete understanding of the disclosure, and the advantages thereof, reference is now made to the following written description taken in conjunction with the accompanying drawings, in which.

DETAILED DESCRIPTION OF THE DISCLOSURE

Figure 1:
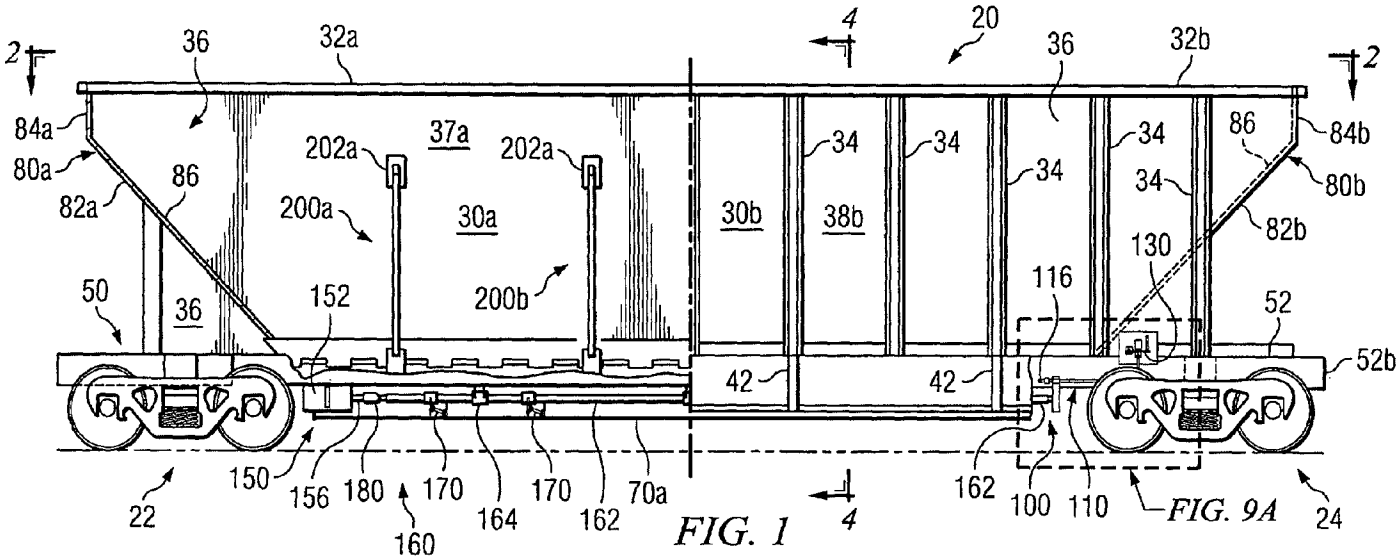
FIG. 1 is a schematic drawing in elevation with portions broken away showing a side view of a railway car incorporating teachings of the disclosure.
Figure 2:
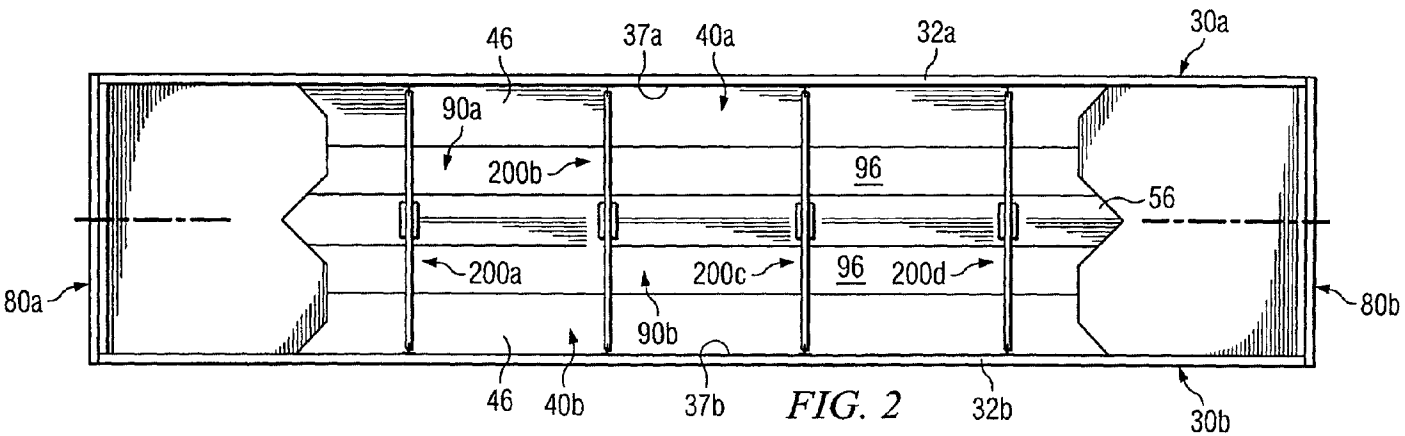
FIG. 2 is a schematic drawing showing a plan view taken along lines 2-2 of FIG. 1.

Preferred embodiments of the disclosure and associated advantages may be best understood by referring to FIGS. 1-15B of the drawings. Like numbers may be used for like and corresponding parts of the various drawings.

Discharge control systems incorporating teachings of the disclosure may be satisfactorily used with a wide variety of railway cars, hopper cars, covered or closed hopper cars, coal cars and ballast cars. For example, various features of the disclosure may be used with closed or covered hopper cars, hopper cars that carry aggregate, ore, grain and other types of bulk lading and ballast cars. Examples of lading carried by covered or closed hopper cars may include, but are not limited to, corn distillers dried grains (DDG), corn condensed distillers solubles (CDS), corn distillers dried grains/solubles (DDGS) and wet distillers grain with solubles (WDGS). Such products may be associated with ethanol production from corn and/or other types of grain.

Teachings of the disclosure may be satisfactorily used with railway cars having a wide variety of discharge control systems, discharge openings, door assemblies or gates. The disclosure may be used with railway cars having longitudinal discharge openings, longitudinal door assemblies, lateral discharge openings and lateral door assemblies. Air cylinders, hydraulic cylinders, various types of motors and capstan drive mechanisms may be used to operate associated discharge control systems.

Various types of operating assemblies and discharge control systems formed in accordance with teachings of the disclosure may be satisfactorily used to open and close door assemblies and/or gates. For some embodiments each discharge control system may include a power source and associated mechanical linkages operable to open and close such door assemblies and/or gates. The mechanical linkages may include a first portion or primary linkage disposed adjacent to and extending longitudinally along an associated center sill. For some applications a primary linkage may extend laterally relative to an associated center sill. A primary linkage may also be referred to as a "common linkage" or "primary linkage assembly".

One or more second portions or secondary linkages may be attached to and extend between a primary linkage assembly and associated door assemblies or gates whereby movement of the first portion or primary linkage results in movement of associated second portions or secondary linkages to open and close associated door assemblies or gates. Such secondary linkages may also be referred to as "secondary linkage assemblies", "door operating arms" or "door operating rods". Door assemblies and gates may also be referred to as "discharge doors" and "discharge gates".

Examples of such first portions may include, but are not limited to, planks, solid bars and tubes. Bars and tubes having generally rectangular, square or circular cross sections may be used as such first portions depending upon design details of each application. The tubes may have generally hollow bores extending therethrough. Partially hollow tubes may also be used.

A primary linkage may also be formed in part by a generally elongated cylindrical bar or rod (hollow or solid) with threads formed on exterior portions of the bar or rod. Other relatively long structural members such as generally C-shaped channels, U-shaped channels and angles may be used to form portions of a primary linkage.

Examples of second portions or secondary linkages may include, but are not limited to, turnbuckles, pivot arms, door operating arms, door operating rods and a wide variety of other mechanical linkages and assemblies. Secondary linkage assemblies may also be generally described as door connector assemblies extending between a respective primary linkage and respective longitudinal door assemblies. Various types of mechanical connectors including, but not limited to, sockets, socket assemblies, ball joints and pivot pins may be used to operably engage secondary linkage assemblies with a respective primary linkage and/or associated longitudinal door assemblies.

Discharge control systems incorporating teachings of the disclosure may be used to open discharge doors having any length as required for an associated railway. As the length of associated discharge doors increases additional secondary linkage assemblies may be added as appropriate. The number of pivot arms or rods required to maintain a tight seal with an associated discharge opening will generally increase as the length of a discharge door increases. For example, very long discharge doors may require three or four pairs of pivot arms or pivot rods to maintain a desired seal with an associated discharge opening. Additional pairs of pivot arms or pivot rods also may be added depending upon the type of lading.

Discharge control systems incorporating teachings of the disclosure may be easily adjusted by lengthening or shortening second portions or secondary linkages and by lengthening or shortening longitudinal travel of an associated first portion or primary linkage. A discharge control system incorporating teachings of the disclosure may be adapted for use in transporting various commodities and various gate sizes by adding or removing secondary linkages.

Capstan drive mechanism may be used as a power source for some discharge control systems. One or more capstans may be provided for engagement by a wayside drive system (sometimes referred to as "railcar gate openers" or "hopper car gate openers") located at a discharge facility exterior to an associated railway car. A typical wayside drive system (not expressly shown) may include a hydraulic motor, an air motor or an electrical motor mounted on a dolly or other suitable platform adjacent to railway tracks at an unloading facility. Such wayside power systems are often movable relative to a railway car disposed on the tracks. A gripper or similar mechanism may extend from the dolly or platform to engage a capstan associated with the discharge control system when the railway car and wayside power systems are positioned adjacent to each other. A motor on the dolly or platform may then rotate the gripper or similar mechanism to rotate the capstan to open or close associated discharge doors or gates.

Figure 12:
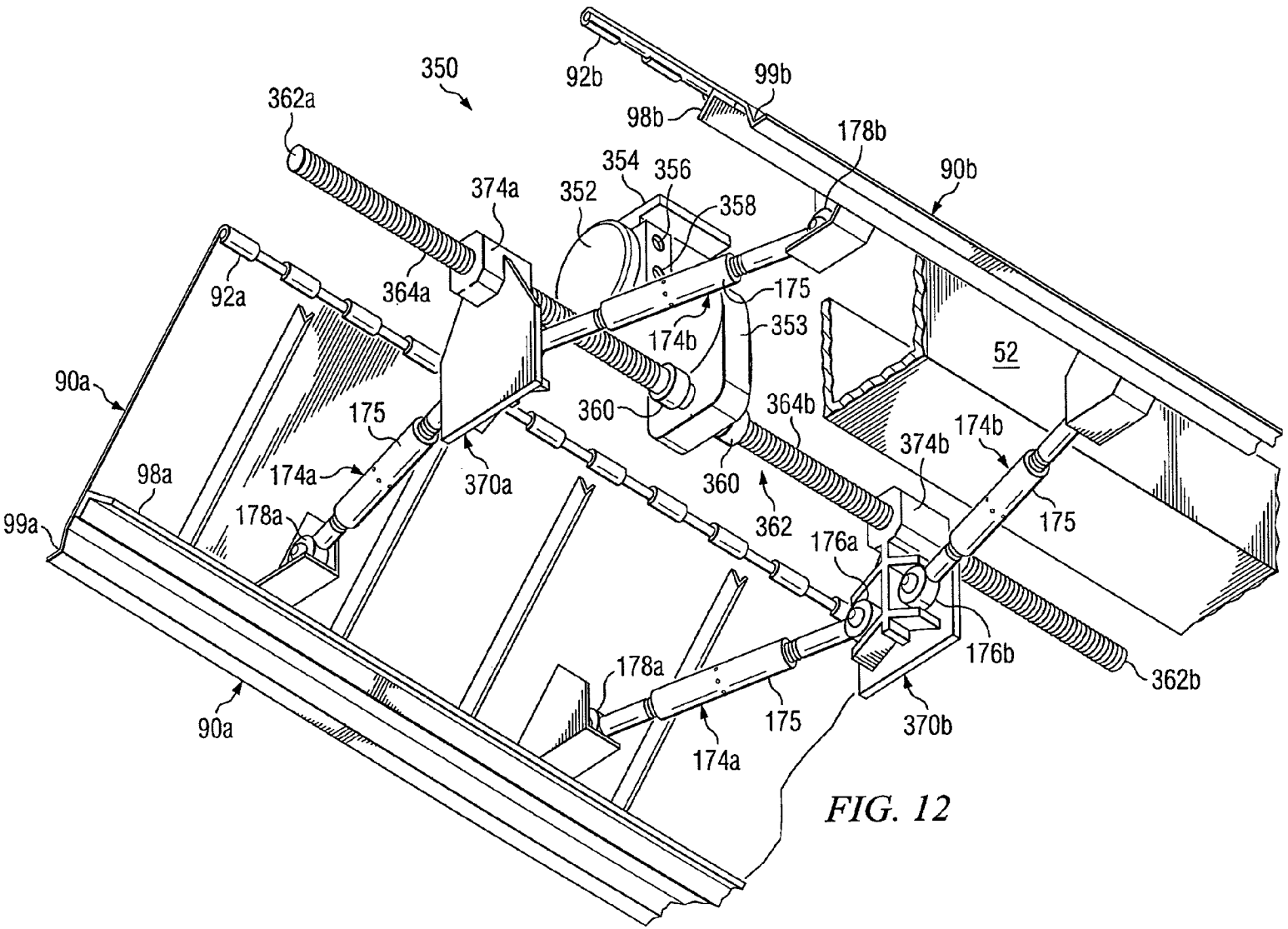
FIG. 12 is an enlarged schematic drawing in section with portions broken away showing another example of a railway car and discharge control system incorporating teachings of the disclosure with a pair of door assemblies in their first, closed position.
Figure 13:
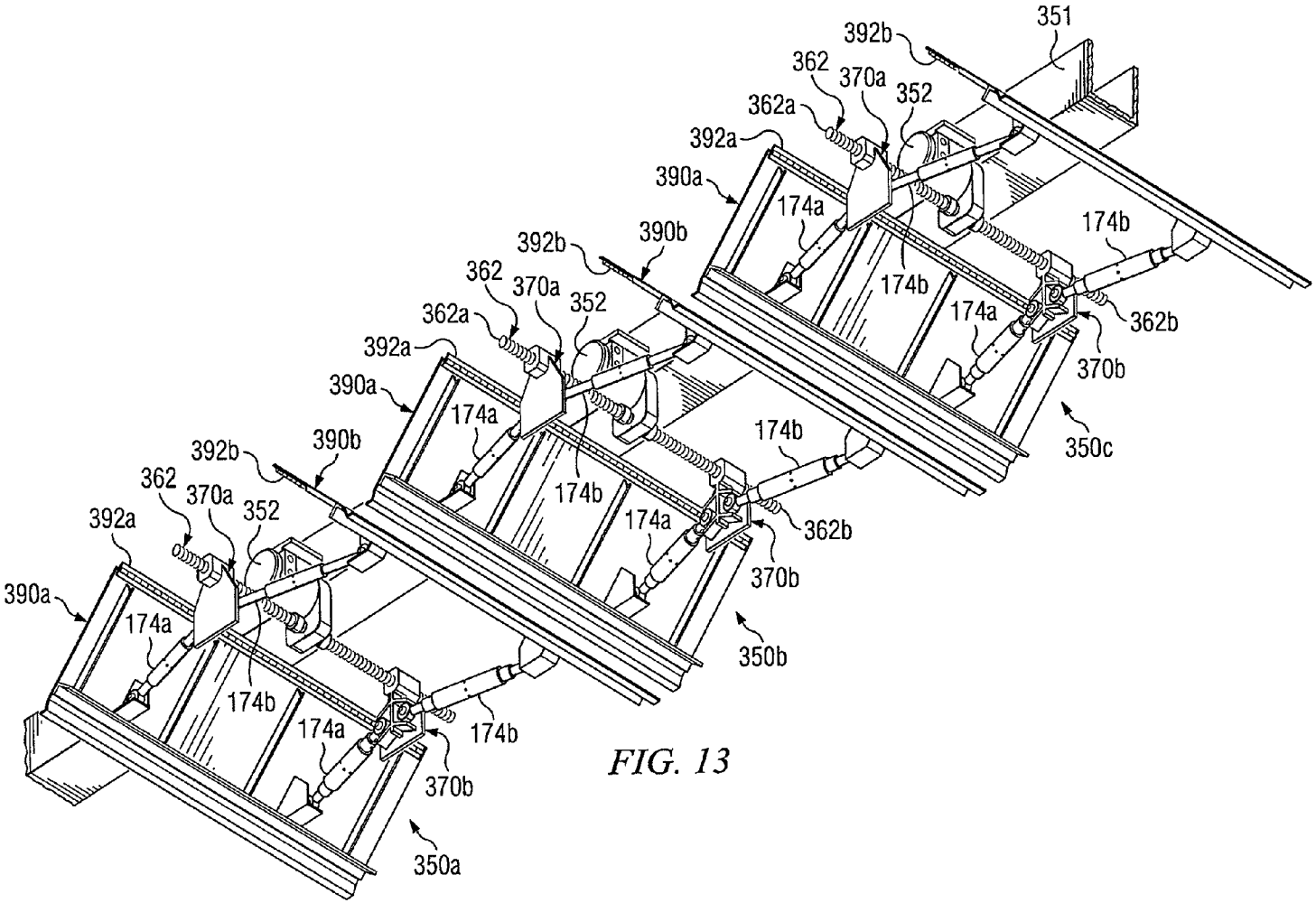
FIG. 13 is a schematic drawing showing an isometric view with portions broken away of a railway car having multiple discharge control systems incorporating teachings of the disclosure with each discharge control system having a respective primary linkage extending generally normal or perpendicular relative to an associated center sill.

Various features of the disclosure may be described with respect to discharge control system 150 (FIGS. 1-8C), discharge control system 250*a* (FIG. 10), discharge control systems 250*b* (FIGS. 11A, 14, 15A and 15B), discharge control systems 350 (FIG. 12) and discharge control systems 350*a*, 350*b* and 350*c* (FIG. 13). Discharge control systems 150, 250*a*, 250*b*, 350, 350*a*, 350*b* and 350*c* may be described with respect to railway cars used to carry coal, grain, sand, metal ores, aggregate ballast and a wide variety of other types of lading.

Figure 14:
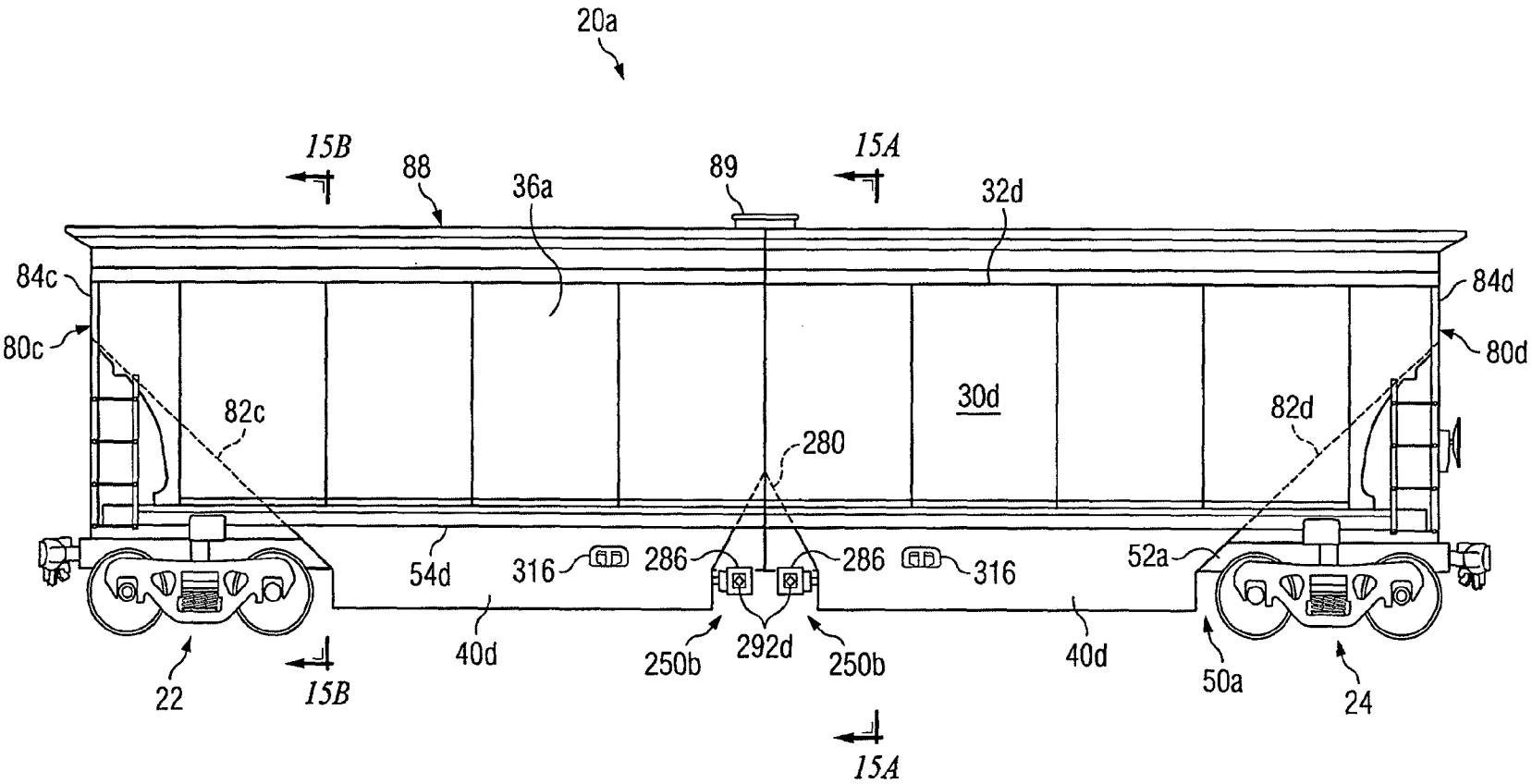
FIG. 14 is a schematic drawing in elevation with portions broken away showing a side view of a closed hopper car or grain car incorporating teachings of the disclosure.
Figure 15A:
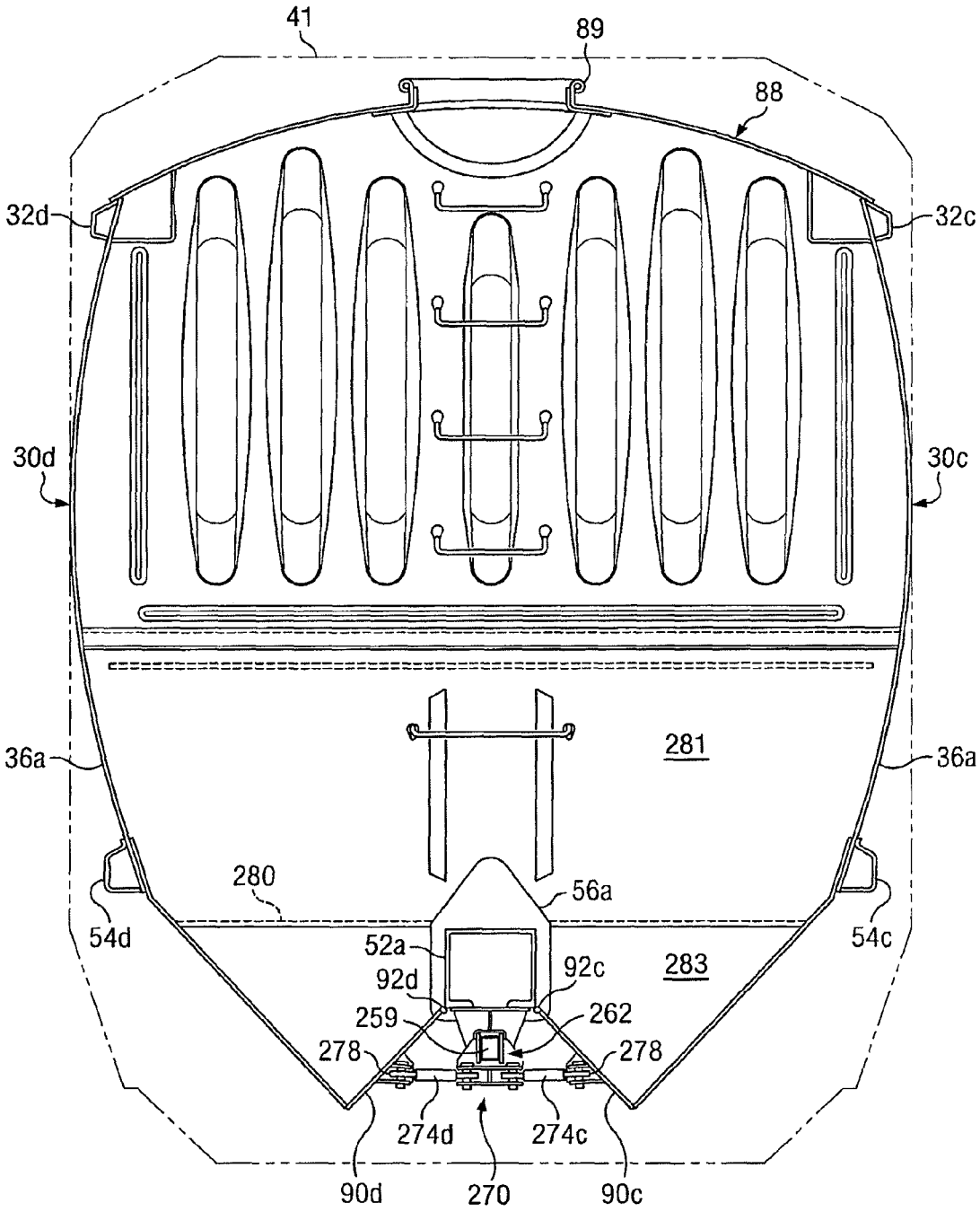
FIG. 15A is a schematic drawing in section taken along lines 15A-15A of FIG. 14.
Figure 15B:
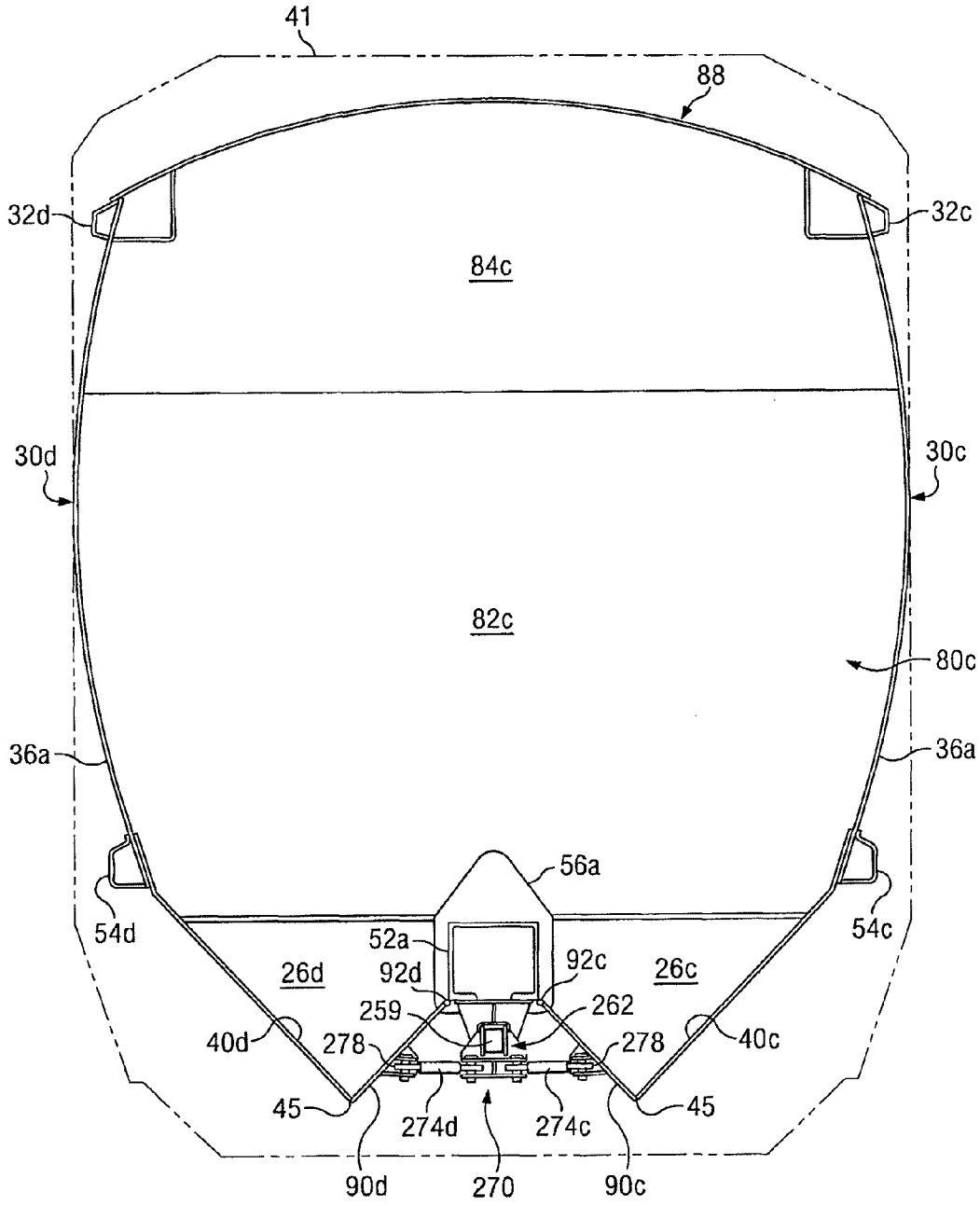
FIG. 15B is a schematic drawing in section taken along lines 15B-15B of FIG. 14.

Typical dimensions for a coal car incorporating teachings of the disclosure may include length between truck centers of approximately forty (40) feet six (6) inches; a length over strikers of approximately fifty (50) feet two and one half (2½) inches; and a length over pulling faces of approximately fifty-three (53) feet and one (1) inch. Dimensions for one example of a covered hopper car or grain car incorporating teachings of the disclosure are discussed with respect to railway car 20*a* as shown in FIGS. 14, 15A and 15B.

Railway car 20 incorporating teachings of the disclosure may include a pair of sidewall assemblies 30*a* and 30*b*, bottom slope sheet assemblies 40*a* and 40*b* and sloped end wall assemblies 80*a* and 80*b* mounted on railway car underframe 50. For embodiments of such as shown in FIGS. 1-8C, railway car 20 may be generally described as having a single, open hopper defined in part by sidewall assemblies 30*a* and 30*b*, bottom slope sheet assemblies 40*a* and 40*b* and sloped end wall assemblies 80*a* and 80*b* mounted on railway car underframe 50. Other railcars formed in accordance with teachings of the disclosure may include two or more hoppers. See FIGS. 14, 15A and 15B.

Railway car underframe 50 may include center sill 52 and side sills 54*a* and 54*b*. See FIGS. 4, 8A, BE and 8C. Side sills 54*a* and 54*b* may extend generally parallel with center sill 52 and spaced laterally from opposite sides of center sill 52. Railway trucks 22 and 24 may be attached proximate respective ends of center sill 52. For some embodiments represented by railway car 20, center sill 52 may have a generally rectangular or square cross-section. Generally triangular shaped dome assembly or cover 56 may be disposed on portions of center sill 52 extending between end wall assemblies 80*a* and 80*b*.

The disclosure may be used with center sills having a wide variety of configurations and designs other than a rectangular or square cross section. The disclosure may be used with center sills that do not have domes or covers. The disclosure is not limited to center sill 52 or cover 56.

Sidewall assemblies 30*a* and 30*b* may have approximately the same overall configuration and dimensions. Therefore, only sidewall assembly 30*b* will be described in detail. Sidewall assembly 30*b* preferably includes top chord 32*b* with a plurality of side stakes or support parts 34 extending between top chord 32*b* and side sill 54*b*. Side stakes or support parts 34 may also be spaced longitudinally from each other along the length of top chord 32*b* and side sill 54*b*. A plurality of metal sheets 36 may be securely attached with interior portions of top chord 32*b*, side stakes 34 and side sill 54*b*. In a similar manner, sidewall assembly 30*a* may include top chord 32*a*, side stakes 34, respective metal sheets 36 and side sill 54*a*.

Metal sheets 36 may form interior surface 37 and exterior surface 38 of respective sidewall assemblies 30*a* and 30*b*. Respective interior surfaces may be referred to as 37*a* and 37*b*. Respective exterior surfaces may be referred to as 38*a* and 38*b*.

Bottom slope sheet assemblies 40*a* and 40*b* may have approximately the same overall dimensions and configuration. Therefore, only bottom slope sheet assembly 40*b* will be described in more detail. Bottom slope sheet assembly 40*b* may include a plurality of angles 42 extending inwardly from side sill 54*b* to bottom chord 44*b*. Bottom chord 44*b* and top chord 32*b* may be formed from hollow metal tubes having generally rectangular configurations. A plurality of metal sheets 46 may be attached with interior surfaces of respective angles 42 and bottom chord 44*b*. Metal sheets 36 and 46 may have similar specifications and thickness.

For some applications, an additional angle 48*b* may be attached to bottom chord 44*b* opposite from associated angles 42 to provide additional structural strength for railway car 20. Bottom chord 44*b* and angle 48*b* preferably extend along substantially the full length of railway car 20. In a similar manner, bottom slope sheet assembly 40*a* may include respective angles 42, respective metal sheets 46, bottom chord 44*a* and additional angle 48*a*.

Bottom slope sheet assemblies 40*a* and 40*b* may be attached with respective side sills 54*a* and 54*b*. Bottom slope sheet assemblies 40*a* and 40*b* may extend inward at an angle from respective side sills 54*a* and 54*b* to a location proximate bottom clearance or minimum clearance for railway car 20 relative to associated railway tracks 28. See, for example, FIGS. 8A, 8B and 8C. American Association of Railroads (AAR) specifications and operating envelopes define applicable bottom clearance for railway cars. For embodiments of the disclosure represented by railway car 20, bottom slope sheet assemblies 40*a* and 40*b* may extend at an angle of approximately forty five degrees (45°) relative to respective sidewall assemblies 30*a* and 30*b*. The angle of bottom slope sheet assemblies 40*a* and 40*b* may be increased to approximately fifty-two degrees (52°) to aid in the discharge of lading (particularly coal). Angles of approximately fifty-five degrees (55°) may also be used.

Portions of bottom slope sheet assembly 40*a* cooperate with adjacent portions of center sill 52 and dome 56 to define longitudinal discharge opening or outlet 26*a*. In a similar manner portions of bottom slope sheet assembly 40*b* cooperate with adjacent portions of center sill 52 and dome 56 to define in part longitudinal discharge opening or outlet 26*b*. See FIGS. 4, 5, 8A, 8B and 8C. Longitudinal discharge openings 26*a* and 26*b* may be disposed along opposite sides of center sill 52. For some applications a railway car may be formed in accordance with teachings of the disclosure with more than one hopper and more than two discharge openings. The disclosure is not limited to hopper cars with only one hopper and two longitudinal discharge openings. See FIGS. 14, 15A and 15B.

Longitudinal door assemblies 90*a* and 90*b* may be hinged proximate an upper portion of center sill 52 adjacent to dome assembly 56. Longitudinal door assemblies 90*a* and 90*b* may also be described as "door assemblies," "discharge doors," "gates," "discharge gates," "swinging longitudinal slope sheets" and "swing gates." Longitudinal door assemblies 90*a* and 90*b* may be formed with overall dimensions and configurations similar to bottom slope sheet assemblies 40*a* and 40*b* and associated longitudinal discharge openings 26*a* and 26*b*.

Various types of hinges may be satisfactorily used to engage door assemblies 90*a* and 90*b* with portions of center sill 52. Examples of such hinges may include, but are not limited to, heavy duty piano type hinges, spring, continuous, butt, slip apart, and/or weld-on hinges. For example, hinge assemblies 92*a* and 92*b* may include flat plate butt hinges that are bolted between respective door assemblies 90*a* and 90*b* and upper portions of center sill 52 to accommodate pivotal or rotational movement of door assemblies 90*a* and 90*b* between an open and closed position. Examples of piano type hinges 392*a* and 392*b* are shown in FIG. 12.

Each door assembly 90*a* and 90*b* may include a first, closed position which prevents discharge of lading from railway car 20 (see FIGS. 1-5 and 8A) and a second, open position which allows lading to be discharged from respective outlets 26*a* and 26*b* between tracks or rails 28. (See FIG. 8C). Various components of an associated discharge control system including, but not limited to, a primary linkage, a plurality of secondary linkage assemblies, a mechanical stop assembly and an indicator assembly may also have respective first positions associated with the first, closed position of door assemblies 90*a* and 90*b*. Various components of the associated discharge control system may also have respective second positions corresponding generally with the second, open position of door assemblies 90*a* and 90*b*.

Door assemblies 90*a* and 90*b* formed in accordance with teachings of the disclosure may extend along approximately the full length of respective longitudinal discharge openings 26*a* and 26*b*. For some applications the length of longitudinal discharge openings 26*a* and 26*b* and door assemblies 90*a* and 90*b* may be approximately twenty-nine (29) feet. Each door assembly 90*a* and 90*b* may be formed using metal sheets 96*a* and 96*b* having similar thickness and other characteristics associated with metal sheets 36 and 46. Respective angles 98*a* and 98*b* may be attached with the longitudinal edge of each door assembly 90*a* and 90*b* opposite from respective hinges 92*a* and 92*b*. For some application angles 98*a* and 98*b* may be replaced by an I-beam (not expressly shown), a Z-beam (not expressly shown), or any other suitable structural shape.

Figure 4:
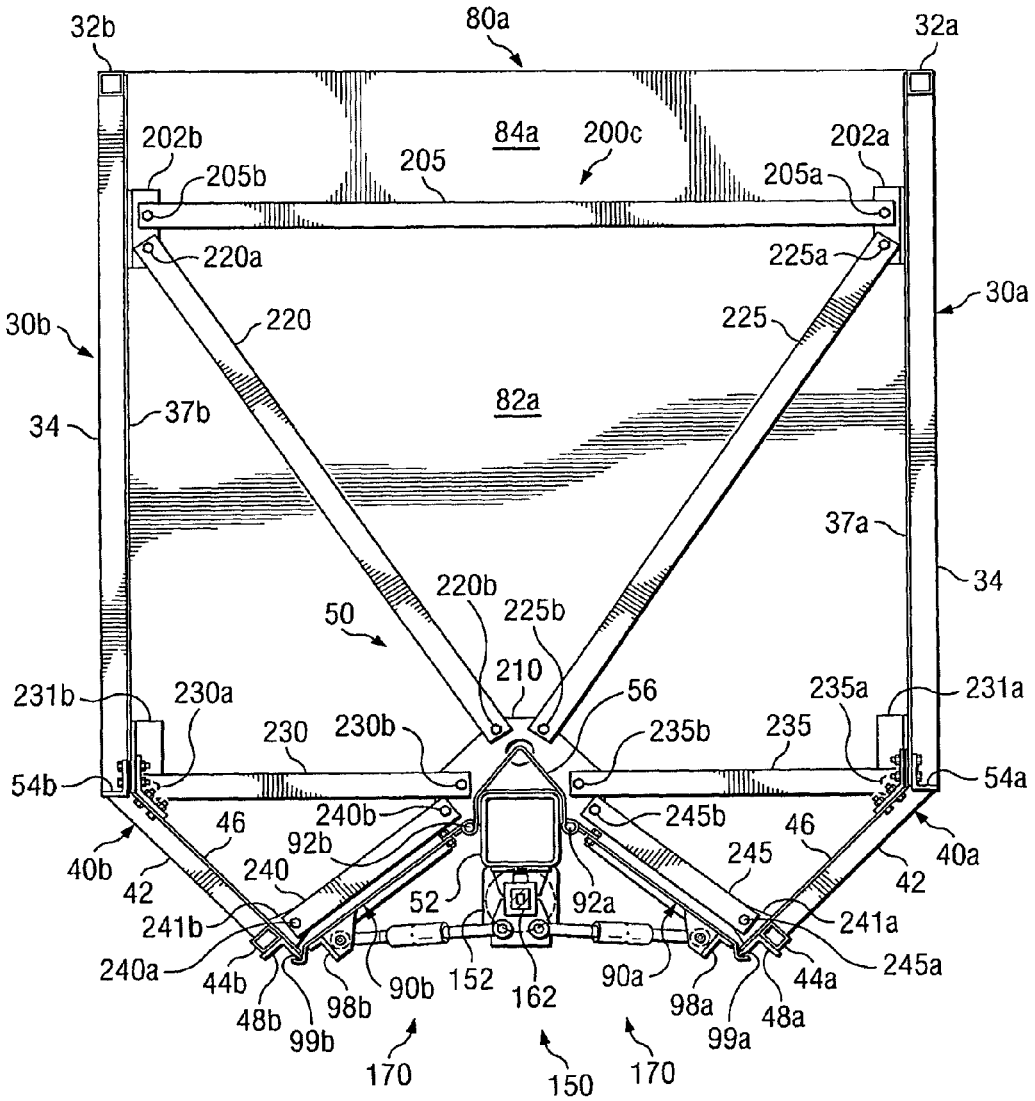
FIG. 4 is a schematic drawing in section taken long lines 4-4 of FIG. 1 showing portions of the railway car and an associated discharge control system with a pair of door assemblies in their first, closed position.
Figure 5:
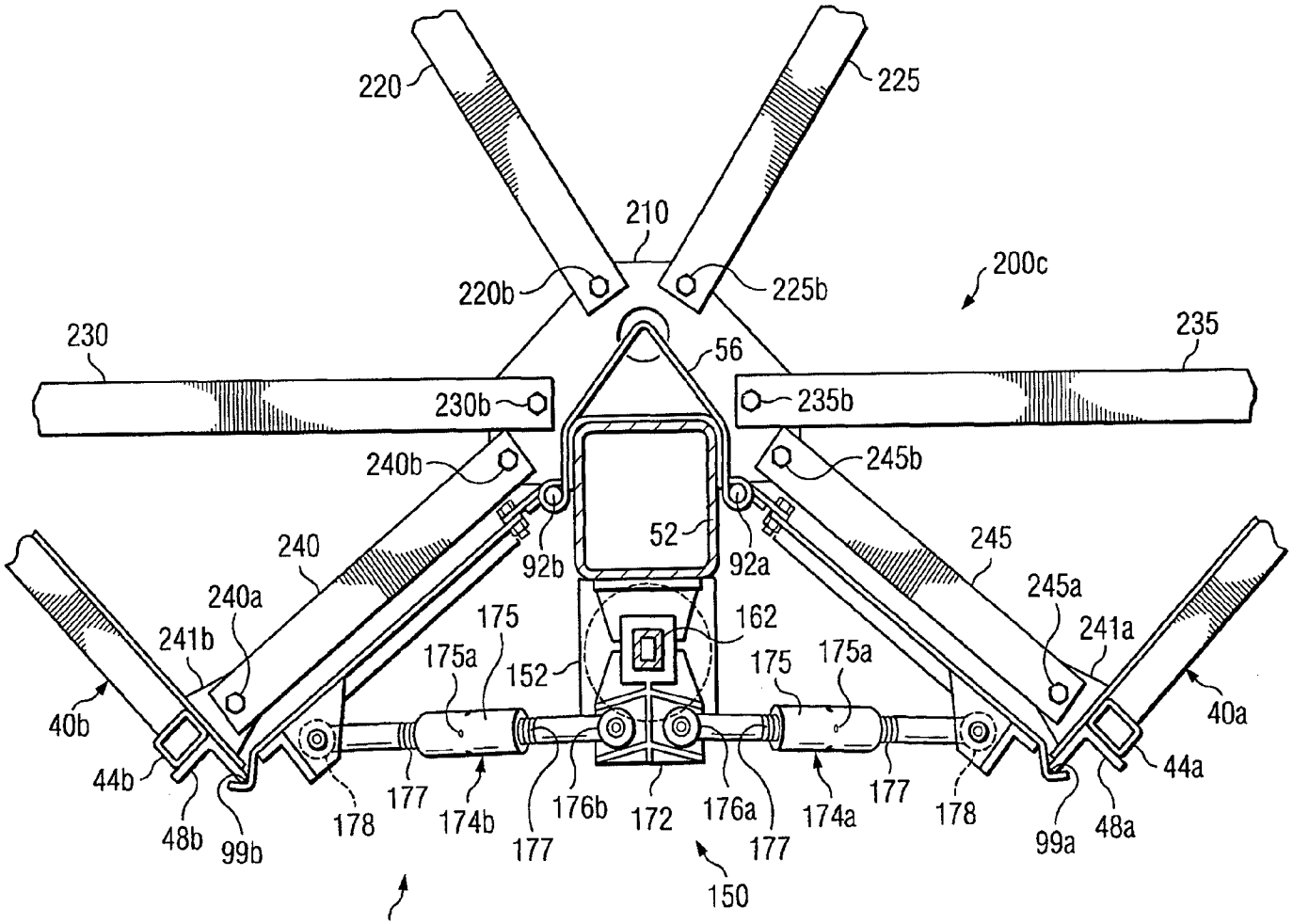
FIG. 5 is an enlarged schematic drawing in elevation and in section with portions broken away showing various components of the discharge control system of FIG. 4 with the door assemblies in their first, closed position.

As shown in FIGS. 4 and 5, respective longitudinal recesses 99*a* and 99*b* may be formed along an edge of each door assembly 90*a* and 90*b* opposite from respective hinges 92*a* and 92*b*. The overall dimensions and configuration of recesses 99*a* and 99*b* may be selected to be compatible with the dimensions and configuration of respective angles 48*a* and 48*b*. In some embodiments, outer edge of recesses 99*a* and 99*b* may extend around angles 48*a* and 48*b* when door assemblies 90*a* and 90*b* are moved to a closed position.

Figure 8A:
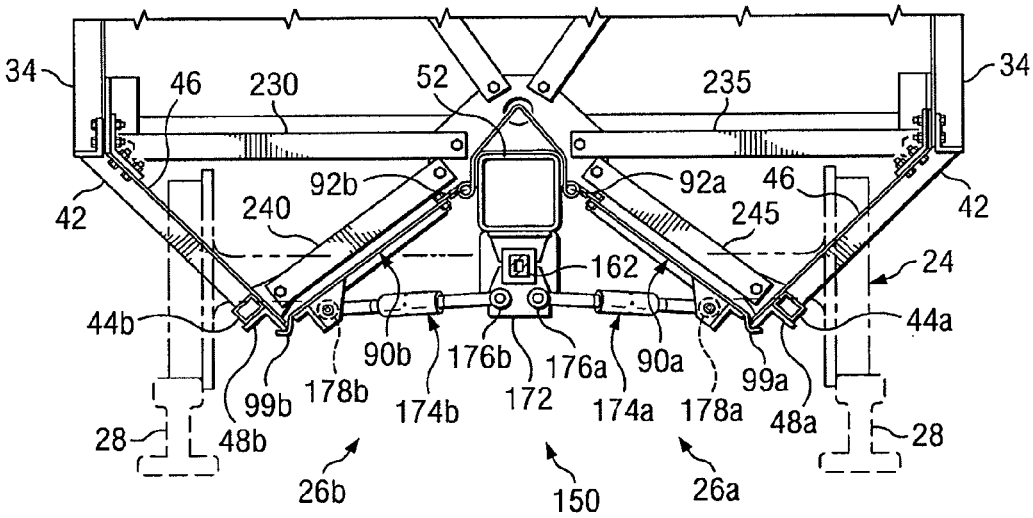
FIGS. 8A, 8B and 8C are schematic drawings in section with portions broken away showing movement of longitudinal door assemblies from their first, closed position to their second, open position to accommodate discharge of lading between rails or tracks on which a railway car incorporating teachings of the disclosure is mounted.
Figure 8B:
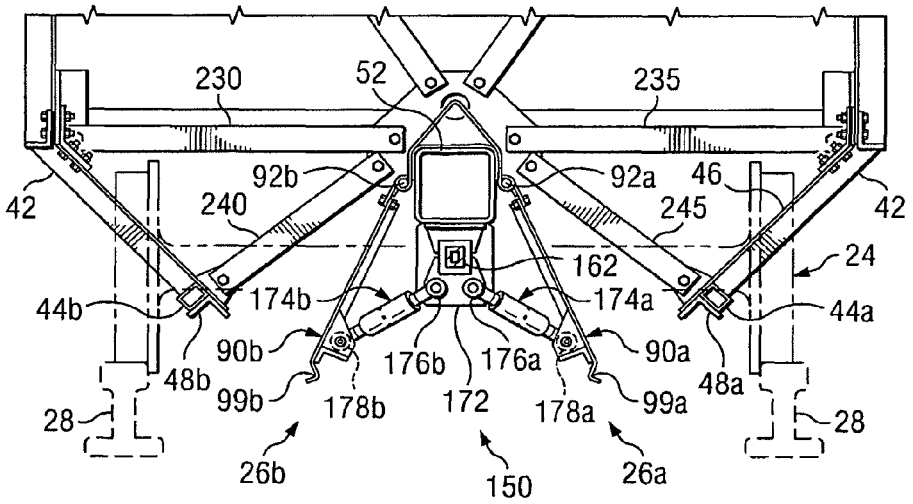
Figure 8C:
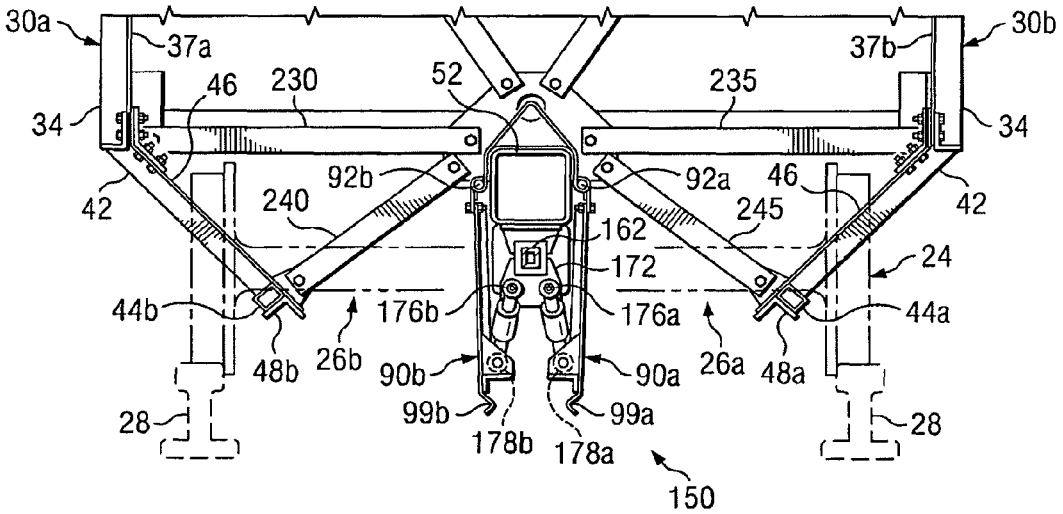

As shown in FIGS. 4, 5 and 8A recesses 99*a* and 99*b* cooperate with respective angles 48*a* and 48*b* to help seal respective longitudinal discharge openings 26*a* and 26*b* to eliminate or substantially minimize any leakage of lading from railway car 20. Various types of sealing mechanisms may be satisfactorily used to engage a door assembly with adjacent portions of a bottom slope sheet assembly in accordance with teaching of the disclosure. The disclosure is not limited to recesses 99 and/or angles 48.

End wall assemblies 80*a* and 80*b* may have approximately the same overall configuration and dimensions. Therefore, only end wall assembly 80*a* will be described in detail. For some applications end wall assembly 80*a* may include sloped portion 82*a* and generally vertical portion 84*a*. The angle of sloped portions 82*a* and 82*b* may be increased to aid in discharge of lading (particularly coal) from railway car 20. Sloped end wall assembly 80*a* may be formed from one or more metal sheets 86. Metal sheets 86 may have similar thickness and other characteristics associated with metal sheets 36 and 46.

For some embodiments such as shown in FIGS. 1-4, railway car 20 may be generally described as having a single hopper defined in part by sidewall assemblies 30*a* and 30*b*, sloped end wall assemblies 80*a* and 80*b* and bottom sloped sheet assemblies 40*a* and 40*b*. Other railway cars incorporating teachings of the disclosure may include two or more hoppers.

A plurality of interior supporting structures or interior brace assemblies 200 (see FIGS. 2, 4 and 5) may be disposed within railway car 20 extending between sidewall assemblies 30*a* and 30*b* and bottom slope sheet assemblies 40*a* and 40*b*. Various components associated with interior supporting structures 200 may cooperate with each other to provide strength and load carrying capabilities for bottom slope sheet assemblies 40*a* and 40*b* while at the same time providing relatively large longitudinal discharge openings 26*a* and 26*b* adjacent to center sill 52.

For some embodiments interior brace assemblies 200*a*, 200*b*, 200*c* and 200*d* may have substantially the same configuration and dimensions. Therefore, various features of the disclosure will be described with respect to interior brace assembly 200*c* as shown in FIG. 4.

Interior brace assembly 200*c* may sometimes be referred to as a "rib plate assembly". Interior brace assembly 200*c* may include respective rib plate 210 centered over and attached to center sill 52 by a generally U-shaped bracket (not expressly shown). Each U-shaped bracket may include dimensions compatible with upper portions of center sill 52. Various types of mechanical fasteners such as bolts and huck fasteners and/or welding techniques may be satisfactorily used to securely engage each U-shaped bracket and associated rib plate 210 with center sill 52.

Each interior brace assembly 200 preferably includes respective horizontal cross bearers 230 and 235 extending from respective side sills 54*b* and 54*a* and connecting with associated rib plate 210. Typically, horizontal cross bearers 230 and 235 may be attached to and extend generally laterally from associated rib plate 210. Various types of mechanical fasteners such as bolts and huck fasteners and/or welding techniques may be satisfactorily used to securely attach each interior brace assembly 200 with side sills 54*a* and 54*b*. For example, horizontal cross bearer 230 may bolt to respective side sill 54*b* using plate member 231*b* at first end 230*a* and second end 230*b* of cross bearer 230 couples with rib plate 210. Similarly, cross bearer 235 may connect to respective side sill 54*a* using plate member 231*a* at first end 235*a* and second end 235*b* of cross bearer 235 couples with rib plate 210.

Upper diagonal braces 220 and 225 may extend between sidewall assemblies 30*a* and 30*b* and rib plate 210. As shown in FIG. 5, first end 220*a* of upper diagonal brace 220 may be secured proximate sidewall assembly 30*b* at connector plate 202*b* and extend diagonally to connect with rib plate 210 at second end 220*b*. Similarly, first end 225*a* of upper diagonal brace 225 may be secured proximate sidewall assembly 30*a* by connector plate 202*a* and extend diagonally to connect with rib plate 210 at second end 225*b*.

Lower diagonal braces 240 and 245 may extend between bottom slope sheet assemblies 40*a* and 40*b* and associated rib plate 210. First end 240*a* of lower diagonal brace 240 preferably couples to bottom chord 44*b* and angle 48*b* of bottom slope sheet assembly 40*b* being secured by connector plate 241*b*. Second end 240*b* of lower diagonal brace 240 may be secured with associated rib plate 210. In a similar manner first end 245*a* of lower diagonal brace 245 may be connected with bottom chord 44*a* and angle 48*a* of sloped sheet assembly 40*a* by connector plate 241*a*. Second end 245*b* of lower diagonal brace 245 may be secured with rib plate 210.

Horizontal crosspiece 205 may extend between sidewall assemblies 30*a* and 30*b*. First end 205*a* of horizontal crosspiece 205 may be engaged with connector 202*a*. Second end 205*b* of horizontal crosspiece 205 may be engaged with connector plate 202*b*. Pairs of connector plates 202*a* and 202*b* may be mounted on interior surfaces of sidewall assemblies 30*a* and 30*b* at locations generally aligned with respective horizontal cross bearers 230 and 235.

Figure 9A:
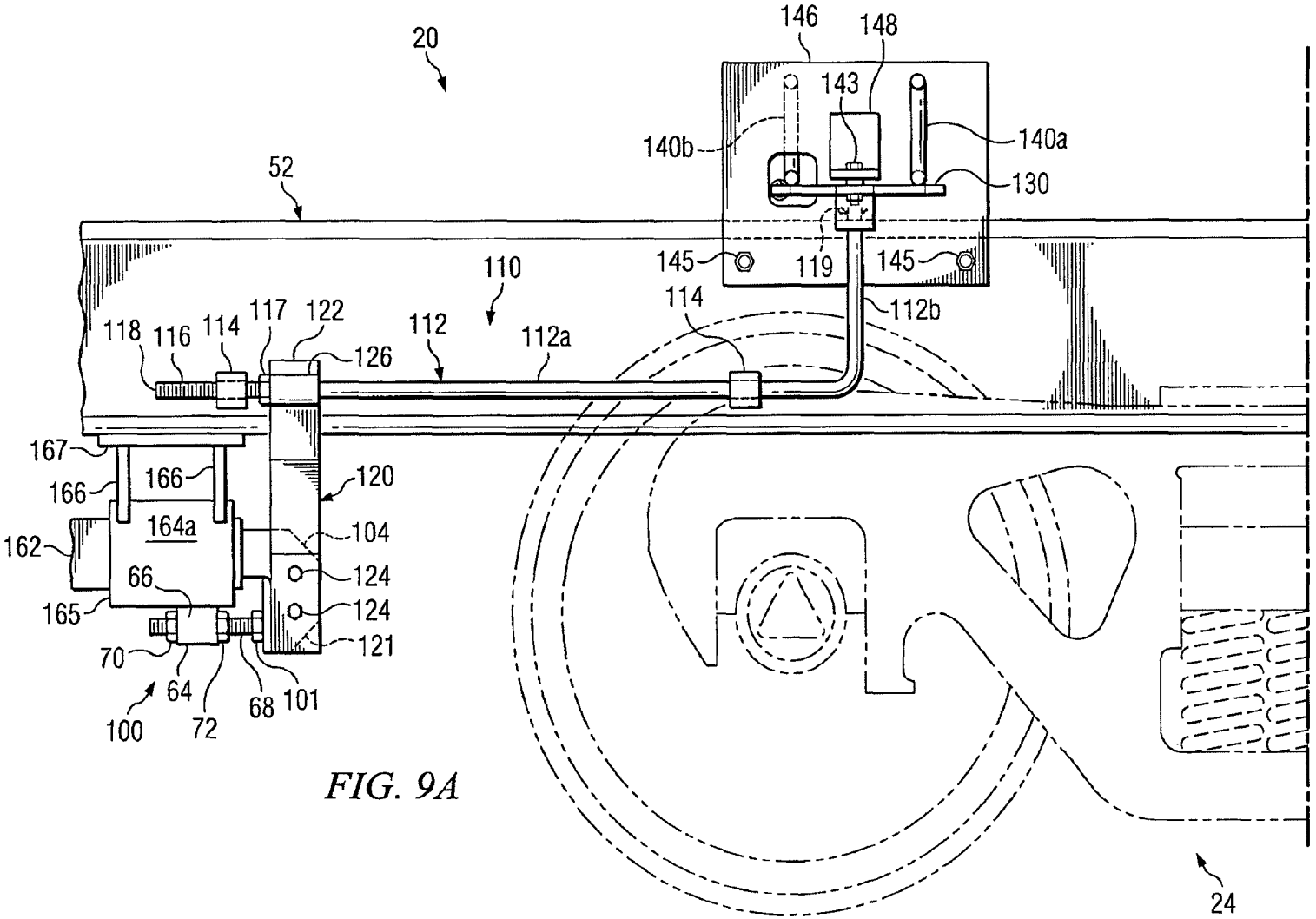
FIG. 9A is a schematic drawing with portions broken away showing one end of a railway car and portions of a discharge control system with a mechanical stop and indicator assembly in a first position.
Figure 9B:
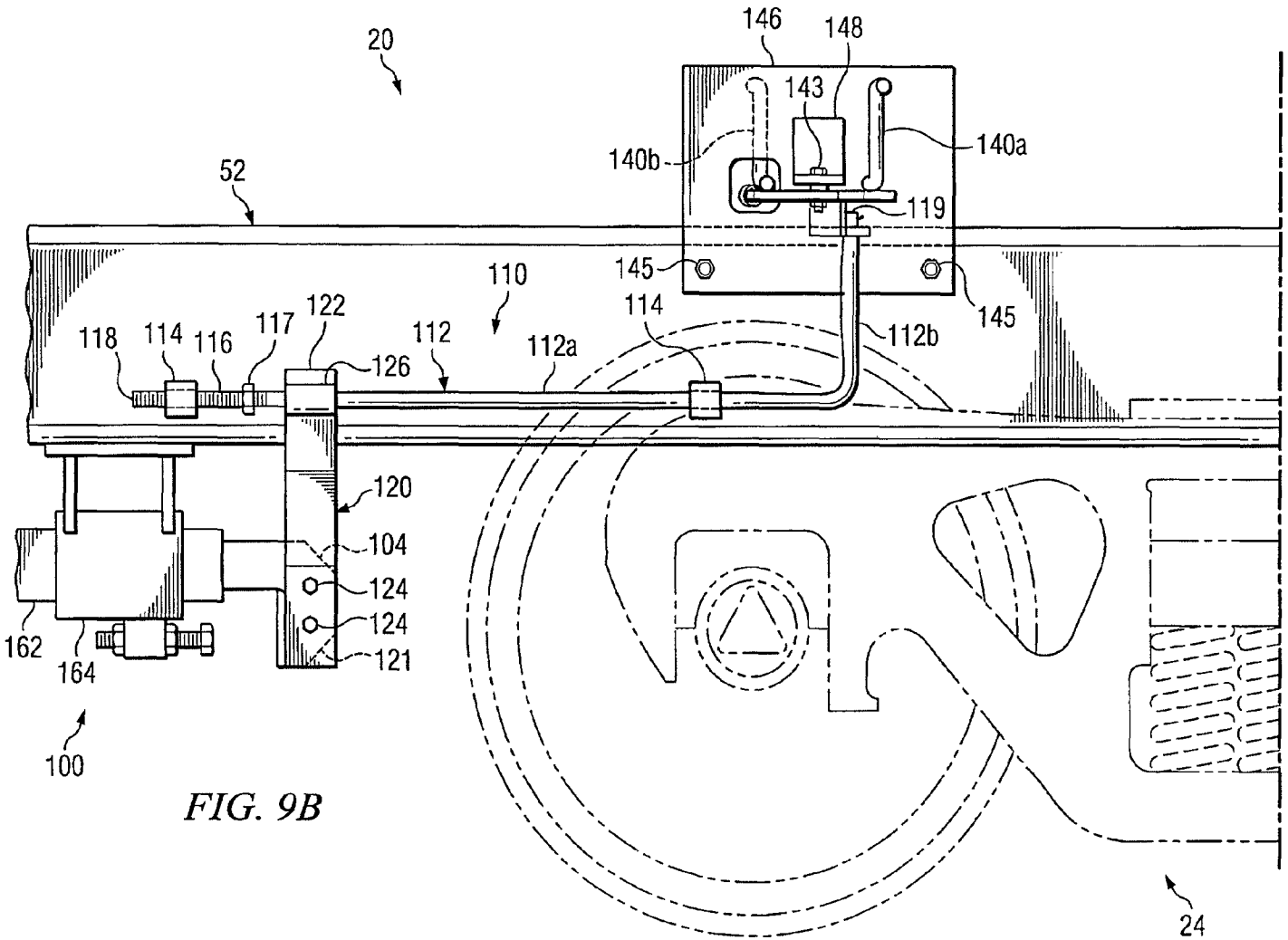
FIG. 9B is a schematic drawing with portions broken away showing the discharge control system and mechanical stop and indicator assembly of FIG. 9A in a second position.

For embodiments such as shown in FIGS. 1-8C discharge control system 150 may include a power source or drive actuator such as air cylinder 152, first portion or primary linkage 162 and a plurality of second portions or secondary linkage assemblies 170. Primary linkage 162 may also be referred to as a "common linkage." Air cylinder 152 may be disposed adjacent to one end of primary linkage 162. Primary linkage 162 may generally be described as elongated structure having a first end proximate air cylinder 152 and a second end proximate mechanical stop assembly 100. For embodiments such as shown in FIGS. 9A and 9B mechanical stop assembly 100 may include first abutment 101 engaged with center sill 52 and second abutment 102 operable to move with the second end of primary linkage 162.

Air cylinder 152 may include piston 154 and piston rod 156 disposed therein. Piston 154 and piston rod 156 may be slidably disposed within air cylinder 152. Piston 154 may divide the interior of air cylinder 152 into two variable volume fluid chambers 158*a* and 158*b*. Air pressure can be applied to either chamber 158*a* or 158*b* by one or more conduits (not expressly shown). At the same time air pressure may be released from or vented from the other variable volume fluid chamber 158*a* or 158*b* by one or more conduits (not expressly shown) to cause piston 154 to move longitudinally within air cylinder 152. Because of this movement, piston rod 156 coupled to piston 154 may move generally longitudinally or reciprocate relative to center sill 52 and other components associated with railway car underframe 50. Various types of air flow control mechanisms and bowels (not expressly shown) may be provided to control movement of piston 154 within air cylinder 152.

Air cylinder 152 may be attached, located, placed, coupled or disposed with various portions of railway car 20. In one embodiment air cylinder 152 may be located beneath and securely attached to center sill 52 proximate railway car truck 24 near the A end of railway car 20.

In alternate embodiments, air cylinder 152 may be replaced or supplemented by any suitable power source satisfactory for providing desired movement of primary linkage 162 relative to center sill 52 and other components of an associated discharge control system. For example, discharge control system 150 may include an electrically operated motor (not expressly shown). Other examples of power sources include, but are not limited to, hydraulic actuators, pneumatic actuators, electric actuators, manual actuators such as geared drives, rotating capstans and any other power source or drive actuator associated with railway cars and hopper cars.

For some applications a railway car incorporating teachings of the disclosure may be unloaded while the railway car continues to move over associated tracks. For example, discharge control systems 150 may include a solenoid operated control valve (not expressly shown) operable to provide air to pneumatic cylinder 152. Respective hot shoe mechanisms (not expressly shown) may be provided along each side of the railway car for engagement with electrical contacts (not expressly shown) mounted adjacent to tracks 28 at an unloading facility. When portions of one or both hot shoe mechanisms engage the electrical contacts, an electrical signal may actuate the solenoid operated control valve to direct air to air cylinder 152 to move an associated common linkage from its first position to its second position resulting in opening of associated discharged door assemblies. Another set of electrical contacts may be provided adjacent to tracks 28 to actuate respective hot shoe mechanisms to the associated discharge doors after unloading has been completed without requiring stopping of the train.

Figure 3:
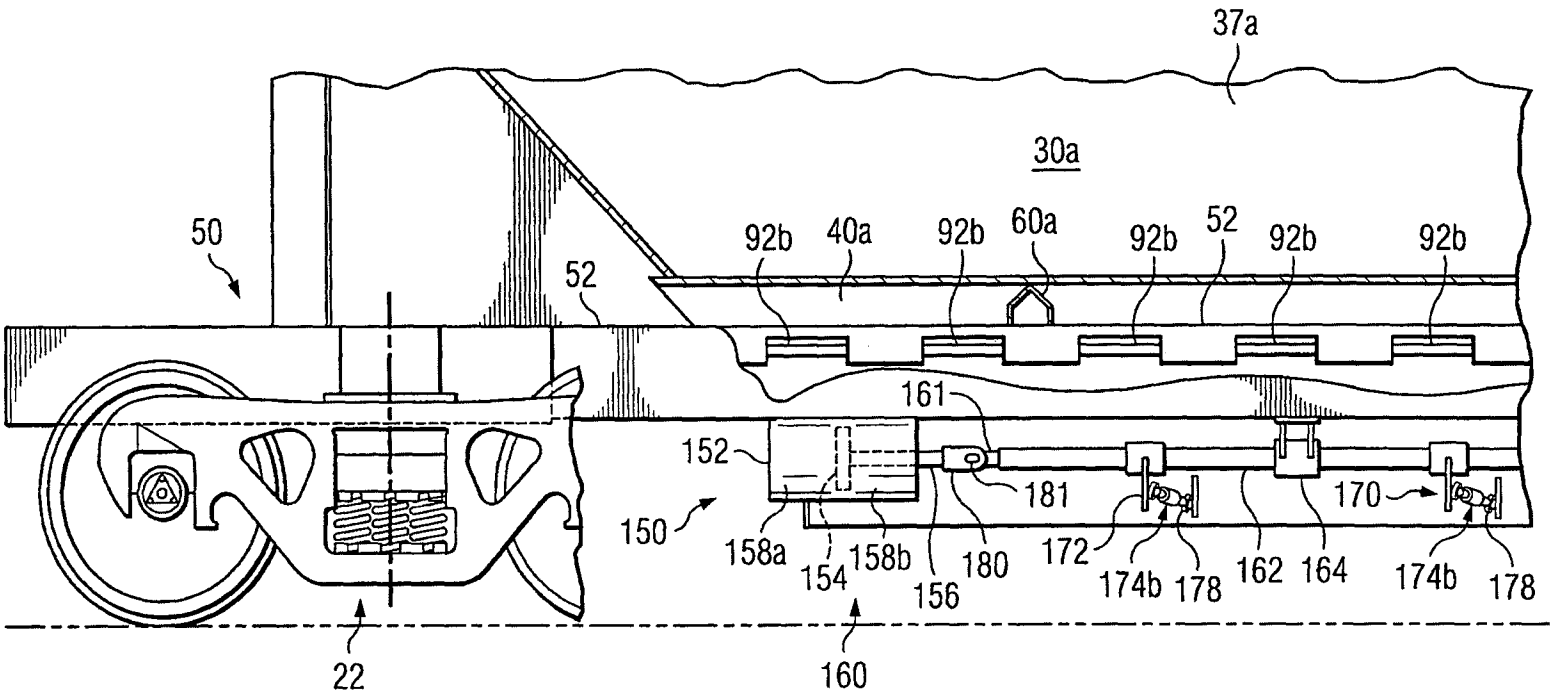
FIG. 3 is a schematic drawing in section and in elevation with portions broken away showing the railway car of FIG. 1 with portions of an associated discharge control system in an over center locked position and associated door assemblies in their first, closed position.
Figure 6:
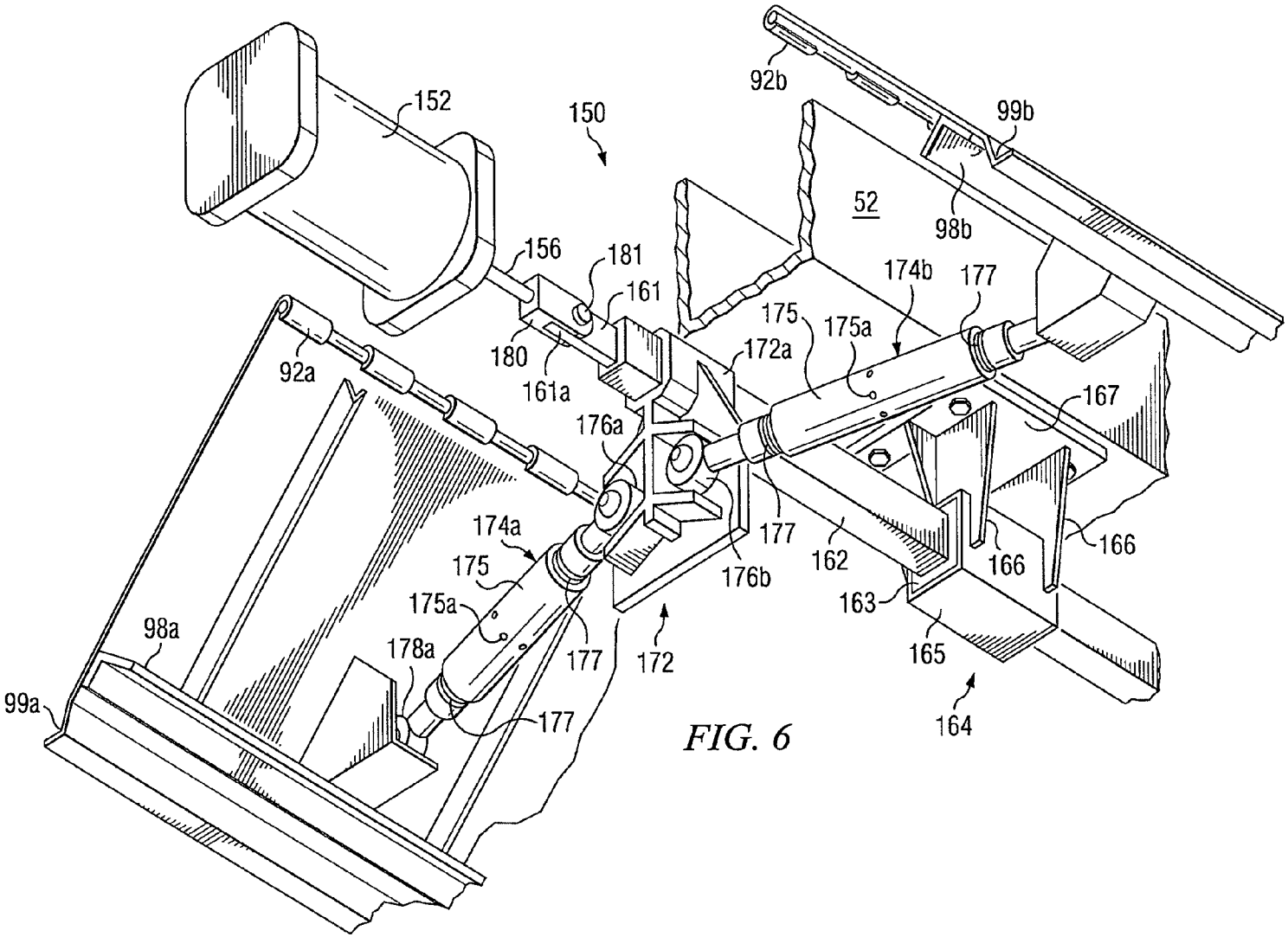
FIG. 6 is a schematic drawing showing an isometric view with portions broken away of a discharge control system and associated door assemblies incorporating teachings of the disclosure.
Figure 7:
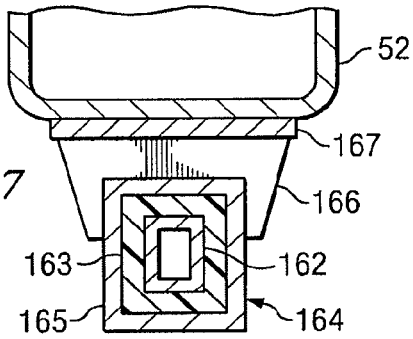
FIG. 7 is a schematic drawing in section with portions broken away showing portions of a discharge control system with a primary linkage or common linkage slidably disposed within a support assembly attached with a center sill in accordance with teachings of the disclosure.

One end of piston rod 156 extending from cylinder 152 may include clevis 180. Pin 181 may be used to engage clevis 180 with connector 161. For embodiments such as shown in FIGS. 3 and 6 connector 161 may be formed as an integral component of primary linkage 162 or may be a separate component which is welded and/or otherwise attached with the first end of primary linkage 162 proximate air cylinder 152. For embodiments such as shown in FIGS. 3 and 6, connector 161 may be described as a relatively short, metal plate or strip as compared with primary linkage 162. Various procedures and techniques may be satisfactorily used to operably engage a power source with a primary linkage other than the use of clevis 180, pin 181 and connector 161. For some applications one end of piston rod 156 may be directly engaged with one end of primary linkage 162.

For embodiments such as shown in FIGS. 1-8C, 9A and 9B, primary linkage 162 may be slidably disposed under center sill 52 of railway car 20. Support assemblies or bearing assemblies 164 may be attached with center sill 52 opposite from dome shaped cover 56. Support assemblies 164 may also be described as "sliding bearings" or "longitudinal bearings". Each support assembly 164 may include housing 165 with a pair of brackets 166 attached thereto. Respective plate 167 may be used to attach each bracket 166 with adjacent portions of center sill 52. Bolts, hucks, and other mechanical fasteners may be used to attach each plate 167 with center sill 52. One of the support assemblies 164, designated 164*a*, may form a portion of mechanical stop assembly 100 operable to limit longitudinal travel of primary linkage 162 as secondary linkage assemblies 170 move to their over center, locked position.

Housing 165 may be described as an elongated, hollow box having a generally square cross section. Bearing material 163 may be disposed within housing 165. The dimensions of housing 165 may be selected to accommodate installing bearing material 163 between exterior portions of primary linkage 162 and adjacent interior portions of housing 165.

The dimensions of housing 165 and bearing material 163 may be selected to allow primary linkage 162 to slide or reciprocate linearly within each support assembly 164 relative to center sill 52. A plurality of support assemblies 164 may be used to maintain primary linkage 162 generally aligned with center sill 52. Various types of bearing materials 163 may be disposed between primary linkage 162 and housing 165 to reduce friction associated with primary linkage 162 sliding relative to housing 165. Examples of such bearing materials include, but are not limited to, ultra high molecular weight plastic (UHMP) and high density polyethylene (HDPE). Such materials are available from a wide variety of manufacturers and suppliers.

Discharge control system 150 may open and close gates or longitudinal door assemblies 90*a* and 90*b* by alternately pushing or pulling first portion or primary linkage 162. One or more secondary portions or secondary linkage assemblies 170 may be attached to primary linkage 162 and connected with longitudinal door assemblies 90*a* and 90*b*. Secondary linkage assemblies 170 may be disposed in generally symmetrical patterns with respect to primary linkage 162 and with respect to each other to help balance forces placed on primary linkage 162 while opening and closing longitudinal door assemblies 90*a* and 90*b* and when secondary linkage assemblies 170 are in an over center locked position.

Each secondary linkage assembly 170 may include respective socket assembly or carriage 172 attached with primary linkage 162 opposite from center sill 52. Each secondary linkage assembly 170 may also include a pair of arms 174*a* and 174*b* which extend from primary linkage 162 to engage respective longitudinal door assemblies 90*a* and 90*b*. Respective first ends 176*a* and 176*b* of each arm 174*a* and 174*b* may include a respective ball joint rotatably engaged with associated socket assembly 172. Respective second ends 178*a* and 178*b* of each arm 174*a* and 174*b* may be rotatably engaged with each door assembly 90*a* and 90*b* spaced from respective hinges 92*a* and 92*b*. For embodiments represented by discharge control system 150, longitudinal movement of first portion or primary linkage 162 relative to center sill 52 may result in three dimensional rotation or radial pivoting of arms 174*a* and 174*b* relative to respective socket assembly 172 to open and close attached longitudinal door assemblies 90*a* and 90*b*.

Substantial forces may be applied to each arm 174*a* and 174*b* when railway car 20 is filled with lading and longitudinal door assemblies 90*a* and 90*b* are closed with secondary linkage assemblies 170 in their over center, locked position. The weight of longitudinal door assemblies 90*a* and 90*b* and the weight of any lading in railway car 20 will typically hold arms 174*a* and 174*b* in their over center locked position until discharge control system 150 applies sufficient force to primary linkage 162 to move arms 174*a* and 174*b* to their unlocked position which results in longitudinal door assemblies 90*a* and 90*b* moving to their second, open position. See FIG. 8C.

Various features of discharge control system 150 and associated indicator assembly 110 may be described with respect to primary linkage 162 moving generally longitudinally in a first direction relative to center sill 52 and moving generally longitudinally in a second direction relative to center sill 52. For embodiments such as shown in FIGS. 1-8C, 9A and 9B, primary linkage 162 may be described as moving in a "first direction" when air cylinder 152 pulls or causes primary linkage 162 to slide longitudinally from railway truck 24 (B end of railway car 20) towards railway truck 22 (A end of railway car 20). Primary linkage 162 may be described as moving in the "second direction" when air cylinder 152 pushes or causes primary linkage 162 to slide longitudinally from railway truck 22 towards railway truck 24.

Longitudinal movement of primary linkage 162 in the first direction relative to center sill 52 will generally pull associated secondary linkage assembly 170 which results in rotation and radial extension of arms 174*a* and 174*b* to push door assemblies 90*a* and 90*b* from their second, open position (see FIG. 8C) to their first, closed position (see FIG. 3). Longitudinal movement of primary linkage 162 in the second direction relative to center sill 52 will generally push secondary linkage assemblies 170 which results in rotation and radial retraction of arms 174*a* and 174*b* to pull door assemblies 90*a* and 90*b* from their first, closed position to their second, open position allowing rapid discharge of any lading contained within railway car 20.

For some applications air cylinder 152 and attached piston rod 156 may be required to only push primary linkage 162 approximately one inch to one and one-half inches in the second direction to unlock arms 174*a* and 174*b* from their over center locked position. After arms 174*a* and 174*b* have been moved from their over center, locked position, the weight of door assemblies 90*a* and 90*b* and particularly the weight of any lading carried within railway car 20 will then move longitudinal door assemblies 90*a* and 90*b* to their second, open position. Air cylinder 152 is generally not required to continue applying force to move primary linkage 162 in the second direction since the weight of any lading within railway car 20 will generally be sufficient to fully open longitudinal discharge door assemblies 90*a* and 90*b*.

Arms 174*a* and 174*b* may be pushed or pulled past center or over center to provide a positive lock to hold longitudinal door assemblies 90*a* and 90*b* in their first, closed position. See, for example, FIGS. 4, 5 and 6. Pulling longitudinal door assemblies 90*a* and 90*b* to their first, closed position and then continuing to pull arms 174*a* and 174*b* to their over center position may sometimes be described as "over center locking".

For some applications arms 174*a* and 174*b* may include respective turnbuckle 175 engaged with threaded portions 177. Each turnbuckle 175 may be rotated by engaging an appropriate tool (not expressly shown) with notch or opening 175*a*. Rotating turnbuckles 175 relative to threaded portions 177 may extend or retract the length of associated arm 174*a* or 174*b*. As a result of rotating turnbuckles 175, the position of door assemblies 90*a* and 90*b* in their respective open and/or closed positions may be adjusted. Rotation of turnbuckles 175 allows adjusting the length of respective arms 174*a* and 174*b* to provide desired closure of each longitudinal door assembly 90*a* and 90*b* relative to respective discharge openings 26*a* and 26*b*.

As previously noted, support assembly 164*a* may form a portion of mechanical stop assembly 100 and may allow adjusting the length of the longitudinal movement of primary linkage 162 relative to center sill 52. For some embodiments, mechanical stop assembly 100 may include first abutment 101 which may be attached to and extend from support assembly 164*a*. Various techniques and procedures may be satisfactorily used to engage first abutment 101 with support assembly 164*a*. For example, manual adjusting device 64 may be engaged with portions of housing 165 to allow varying spacing between first abutment 101 and second abutment 102 when primary linkage 162 is in its second position which generally corresponds with the second position of associated discharge control system 150 and the second, open position of longitudinal door assemblies 90*a* and 90*b*.

Manual adjusting device 64 may include relatively short, hollow sleeve 66 attached with associated housing 165 using various techniques such as welding and/or mechanical fasteners (not expressly shown). Threaded bolt 68 may be slidably disposed within sleeve 66. First abutment 101 may be formed by the head of bolt 68 extending from sleeve 66 towards railway truck 24. Nuts 70 and 72 may be engaged with threaded bolt 68 for use in adjusting the length of bolt 68 extending from support assembly 164*a* in the direction of railway truck 24.

For some applications portions of mechanical stop assembly 100 attached to and extending from the second end of primary linkage 162 may be described as generally L-shaped bar stop or head 104. Second abutment 102 may be formed as part of bar stop or head 104. For some applications the generally L-shaped configuration of head 104 may include first portion 104*a* and second portion 104*b*. The dimensions and configuration of first portion 104*a* may be selected to allow inserting head 104 into the longitudinal bore of primary linkage 162. Second abutment 102 may be formed on second portion 104*b* facing first abutment 101 on threaded bolt 68.

As previously discussed, discharge control system 150 may move primary linkage 162 from its second position (see FIGS. 8C and 9B) which generally corresponds with associated secondary linkage assemblies 170 and associated longitudinal door assemblies 90*a* and 90*b* being in their second, open position to the first position of primary linkage assembly 162 which generally corresponds with associated secondary linkage assemblies 170 and associated door assemblies 90*a* and 90*b* being located in their respective first, closed position. See FIGS. 1, 3, 4, 5, 6 and 8A. The over center locked position of secondary linkage assemblies 170 may be adjusted by rotating nuts 70 and 72 to vary the length or longitudinal distance that thread bolt 68 and first abutment 101 extend from support assembly 164*a* in the direction of railway truck 24. When primary linkage 162 and secondary linkage assemblies 170 have moved associated longitudinal door assemblies 90*a* and 90*b* to their first, closed position, mechanical stop assembly 100 will preferably be in its first position with first abutment 101 and second abutment 102 contacting each other. See FIG. 9A. When primary linkage 162 and secondary linkage assemblies 170 have moved longitudinal door assemblies 90*a* and 90*b* to their second, open position, mechanical stop assembly 100 will preferably be in its second position with first abutment 101 and second abutment 102 spaced from each other. See FIG. 9B.

Referring to FIGS. 9A and 9B, indicator assembly 110 may be used to indicate the status of one or more components associated with discharge control system 150. For some applications indicator assembly 110 may be referred to as an "over center lock indicator" used to indicate the status of primary linkage 162 and secondary linkage assemblies 170.

For some applications such as shown in FIGS. 1, 9A and 9B indicator assembly 110 may be engaged with primary linkage 162 opposite from power source 152. Various components of indicator assembly 110 may be mounted on and attached to center sill 52 proximate mechanical stop assembly 100 and the second end of primary linkage 162. See FIGS. 1, 9A and 9B. For other applications indicator assembly 110 may be engaged proximate the first end of primary linkage 162 proximate power source 152 (not expressly shown). Indicator assembly 110 may include operating rod 112, bracket 120 attached to head 104, pivot plate or trilever 130 and a pair of indicators 140.

The various components of indicator assembly 110 may be located proximate the B end of railway car 20 and attached to or mounted on center sill 52 proximate railway truck 24. Operating rod 112, bracket 120, pivot plate 130, indicators 140 and other components of indicator assembly 110 may be located outside of the hopper or car body formed by sidewall assemblies 30*a* and 30*b* and end wall assemblies 80*a* and 80*b*.

For embodiments such as shown in FIGS. 1, 9A and 9B indicator assembly 110 may include a pair of indicators designated as 140*a* and 140*b*. Indicator 140*a* may be described with respect to sidewall assembly 30*a* and indicator 140*b* may be described with respect to sidewall assembly 30*b*. For example, one end of indicator 140*a* may extend from sidewall assembly 30*a* when portions of discharge control system 50 are in an unsecure or unlocked position. One end of indicator 140*b* may extend from portions of sidewall assembly 30*b* when portions of discharge control system 150 are in an unsecure, unlocked position. See FIG. 9B. The one end of indicator 140*a* may extend through a portion of sidewall assembly 30*a* that extends beyond end wall assembly 80*b*. The one end of indicator 140*b* may extend through a portion of sidewall assembly 30*b* that extends beyond end wall assembly 80*b*. See FIGS. 1, 9A and 9B.

For some applications bracket 120 may be formed from a metal strip or plate having a generally elongated, rectangular configuration. Portions of bracket 120 may be bent to accommodate the configuration and dimensions of support assembly 164*a*, head 104 and center sill 52. See FIGS. 9A and 9B. First end 121 of bracket 120 may be securely engaged with portions of mechanical stop assembly 100. For embodiments such as shown in FIGS. 9A and 9B a pair of bolts 124 may be used to securely engage portions of bracket 120 with head 104. Hollow sleeve 126 may be engaged proximate second end 122 of bracket 120. Various techniques such as welding and/or various types of mechanical fasteners (not expressly shown) may be satisfactorily used to attach hollow sleeve 126 proximate second end 122 of bracket 120.

Operating rod 112 may be generally described as having an elongated, L-shaped configuration defined in part by first portion 112*a* extending generally parallel with center sill 52 and second portion 112*b* extending generally normal or vertical with respect first portion 112*a*. One or more rod supports 114 may be engaged with portions of center sill 52. First portion 112*a* of operating rod 112 may be slidably disposed within rod supports 114.

A plurality of threads 116 may be formed on first portion 112*a* adjacent to first end 118 of operating rod 112. As discussed later in more detail, second end 119 of operating rod 112 may be operably engaged with trilever or pivot plate 130. The dimensions of rod supports 114 and hollow sleeve 126 may be selected to allow first portion 112*a* of operating rod 112 to slide longitudinally therethrough. Bolt 117 may be engaged with threaded portion 116 proximate hollow sleeve 126. The dimensions of bolt 117 may be selected to limit movement of operating rod 112 relative to sleeve 126.

For some applications support plate 146 may be attached with one side of center sill 52 corresponding with the attachment of bracket 120 with head 104. Bolts 145 or other mechanical fasteners may be satisfactorily used to attach support plate 146 with center sill 52. Generally L-shaped mounting bracket 148 may be attached with and extend from support plate 146. Pivot pin 143 may be disposed in bracket 148 spaced from support plate 146. Pivot pin 143 may be used to rotatably engage pivot plate 130 with bracket 148. Support plate 146, L-shaped bracket 148 and pivot pin 143 cooperate with each other to allow limited rotational movement of pivot plate or trilever 130 relative to center sill 52.

Pivot plate or trilever 130 may have a first position such as shown in FIG. 9A corresponding with the first position of primary linkage 162, secondary linkage assemblies 170, longitudinal door assemblies 90*a* and 90*b* and mechanical stop assembly 100. Various holes and/or openings may be formed in trilever or pivot plate 130 to accommodate engagement with second end 119 of portion 112*b* of operating rod 112, indicators 140*a* and 140*b* and pivot pin 143. Pivot plate or trilever 130 may also have a second position such as shown in FIG. 9B which correspond generally with the second position of primary linkage 162, secondary linkage assemblies 170, longitudinal door assemblies 90*a* and 90*b* and mechanical stop assembly 100.

For some applications, a spring (not expressly shown) may be engaged with portions of support plate 146 and a portion of trilever or pivot plate 130. The spring may be used to move trilever or pivot plate 130 from its first position to its second position to extend respective ends of indicators 140*a* and 140*b* from respective sidewall assemblies 30*a* and 30*b*.

As previously noted, various types of discharge control systems incorporating teachings of the disclosure may be satisfactorily used with a wide variety of railway cars. For example, discharge control system 250*a* (FIG. 10) or discharge control system 250*b* (FIG. 11A) incorporating teachings of the disclosure may be attached to portions of center sill 52*a*. See also FIGS. 14, 15A and 15B.

Figure 10:
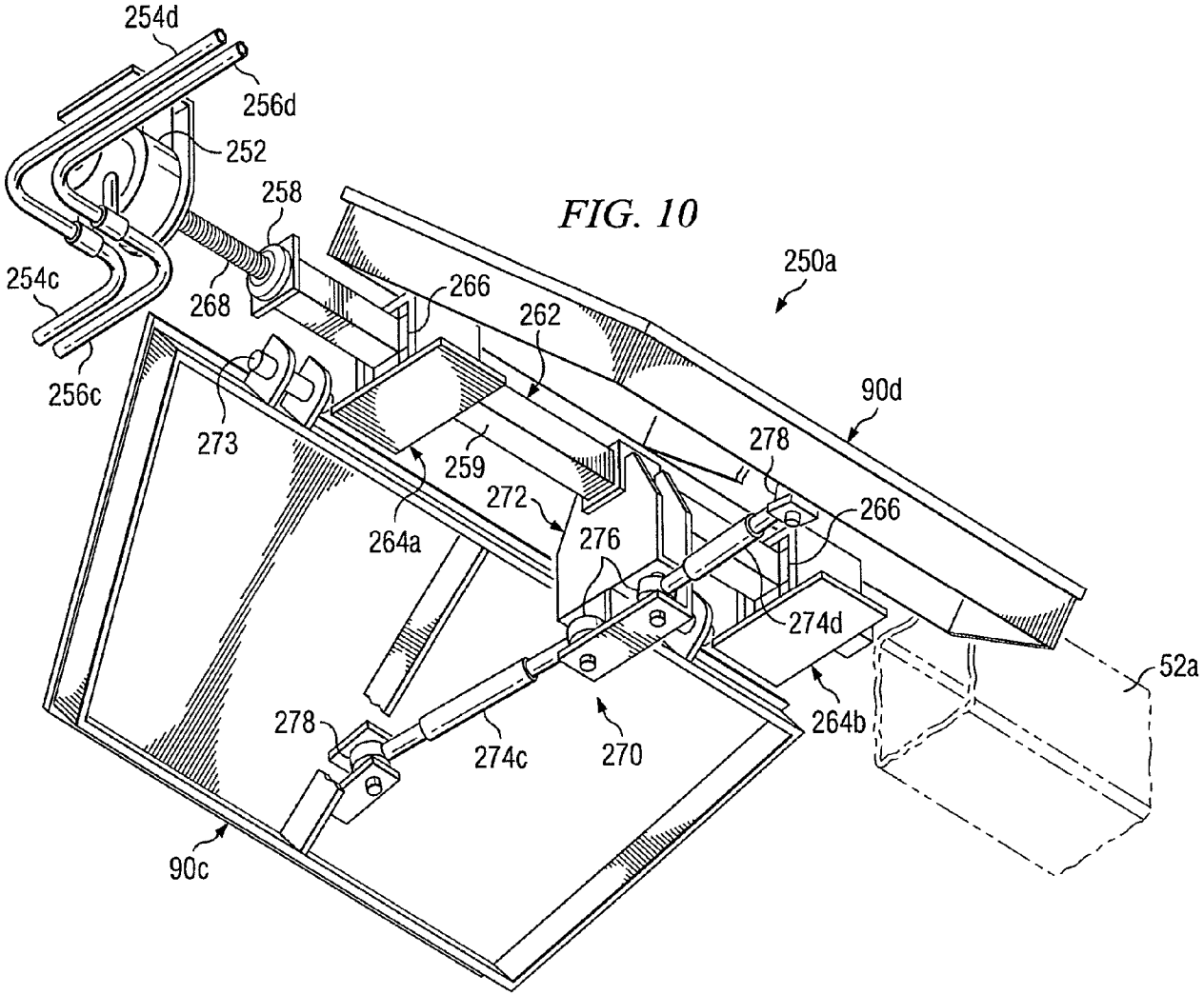
FIG. 10 is an isometric drawing with portions broken away showing an isometric view of one example of a discharge control system including a motor and a pair of associated door assemblies in an intermediate position between open and closed in accordance with teachings of the disclosure.

Discharge control system 250*a* as shown in FIG. 10 may include a power source or drive actuator such as motor 252, first portion or primary linkage 262 and second portion or secondary linkage assembly 270. Multiple secondary linkage assemblies 270 may be used for some applications. The disclosure is not limited to one secondary linkage assembly and one pair of associated pivot arms. Multiple pairs of pivot arms may be provided as appropriate for each railway car.

Various components of discharge control system 250*a* may have respective first positions corresponding generally with a first, closed position associated with longitudinal door assemblies 90*c* and 90*d* and respective second positions corresponding generally with a second, open position associated with longitudinal door assemblies 90*c* and 90*d*.

Figures 11A, 11B:
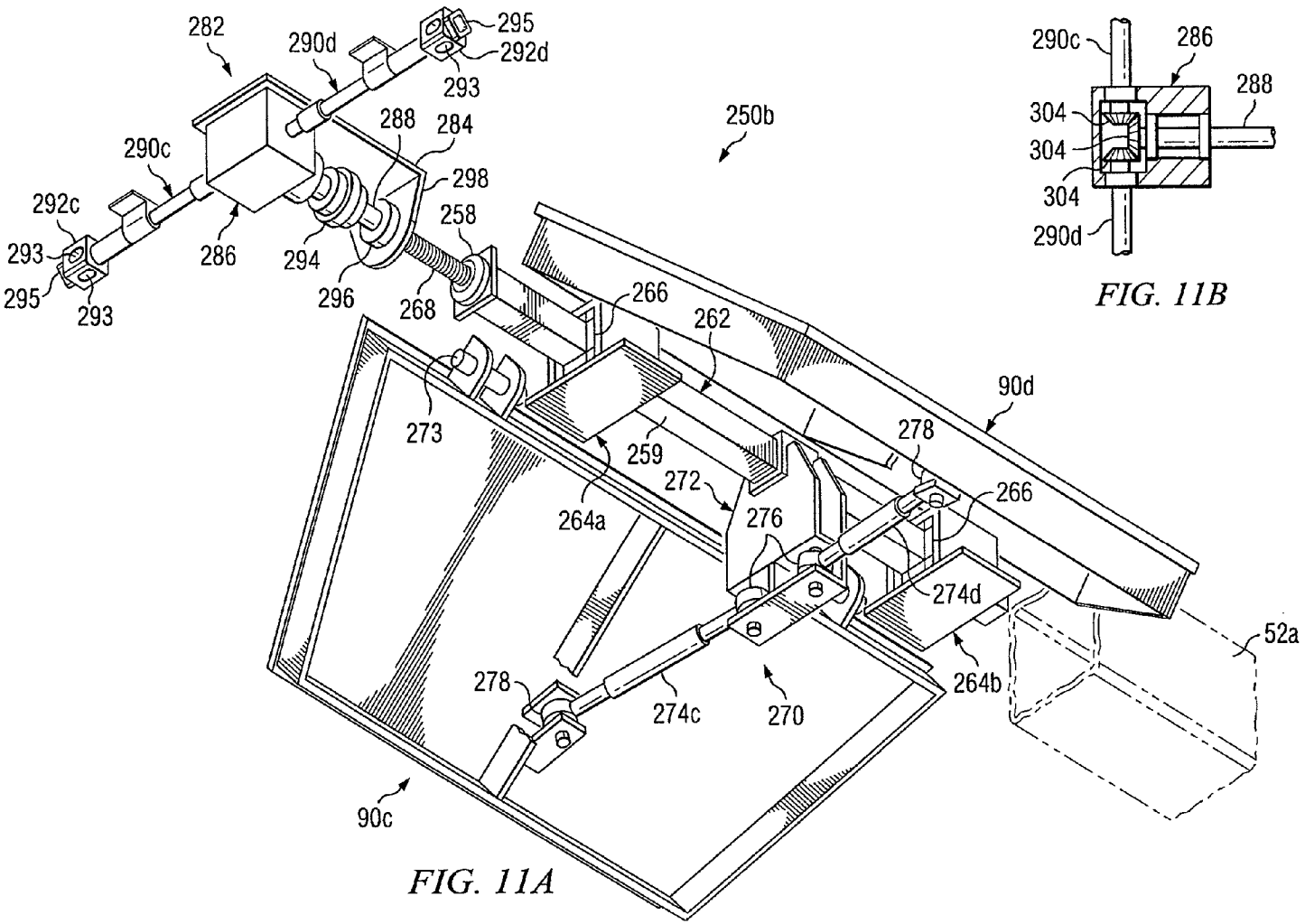
FIG. 11A is a schematic drawing with portions broken away showing an isometric view of the discharge control system of FIG. 10A having a capstan drive mechanism incorporation teachings of the disclosure.
FIG. 11B is a schematic drawing in section with portions broken away showing one example of a gear box satisfactory for use with the capstan drive mechanism of FIG. 11A.

In FIGS. 10 and 11A door assemblies 90*c* and 90*d* are shown in an intermediate position between closed and open. One of the benefits of a discharge control system having a threaded rod or threaded bar incorporating teachings of the disclosure may include the ability to incrementally position associated door assemblies between respective open and closed positions. For example, motor 252 (FIG. 10) or capstan drive mechanism 282 (FIG. 11A) may be used to closely regulate opening of door assemblies 90*c* and 90*d* to control discharge of lading such as grain from an associated hopper.

Motor 252 may be disposed adjacent to a first end of primary linkage 262 such as previously described with respect to primary linkage 162. For some applications a mechanical stop assembly (not expressly shown) may be provided proximate a second end of primary linkage 262 opposite from air motor 252.

In alternative embodiments, motor 252 may be replaced by any suitable power source satisfactory for providing desired movement of primary linkage 262 relative to center sill 52*a* and other components of discharge control system 250*a*. For example, air motor 252 may be replaced by an electrical motor (not expressly shown) or a hydraulic motor (not expressly shown). Other examples of power sources may include, but are not limited to, hydraulic actuators, pneumatic actuators, electric actuators, manual actuators, capstan drive mechanisms and other power sources and drive actuators associated with railway cars and hopper cars.

For embodiments such as shown in FIGS. 10 and 11A, primary linkage or common linkage 262 may include various components such as threaded rod or threaded bar 268, drive nut 258 and generally hollow tube 259. Hollow tube 259 may be generally described as having an elongated configuration with a generally square cross section. Exterior dimension of hollow tube 259 may be compatible with the dimensions associated with support brackets 264*a*, 264*b* and low friction, polymeric materials 266.

Drive nut 258 may be engaged securely with one end of hollow tube 259 adjacent to power source 252 (FIG. 10) or power source 282 (FIG. 11A). Drive nut 258 may remain stationary relative to hollow tube 259 while moving longitudinally with hollow tube 259. Drive nut 258 may include interior threads (not expressly shown) compatible with threads formed on exterior portions of thread rod 268. Drive nut 258 and associated threads represents one example of a "threaded coupling" operable to translate rotation of a threaded rod into linear movement. Drive nut 258 may be formed from various metals such as bronze or from various polymeric materials such as nylon.

One end of threaded rod 268 (not expressly shown) may be inserted through drive nut 258 and disposed within adjacent portions of hollow tube 259. During assembly of discharge control system 250*a*, motor 252 may be securely engaged with the end of threaded rod 268 opposite from drive nut 258 and hollow tube 259.

A plurality of brackets or supports 264*a* and 264*b* may be securely engaged with portions of center sill 52*a*. The dimensions and configuration of brackets 264*a* and 264*b* may be selected to allow portions of primary linkage or common linkage 262 to slide within brackets 264*a* and 264*b* relative to center sill 52*a*. Brackets 264*a* and 264*b* cooperate with each other to maintain primary linkage 262 generally aligned with center sill 52*a* and respective longitudinal door assemblies 90*c* and 90*d*. For some applications various types of low friction, polymeric materials 266 may be disposed between exterior portions of primary linkage 262 and adjacent portions of respective brackets 264*a* and 264*b* to reduce friction associated with linear, sliding movement of primary linkage 262 therethrough.

For some embodiments threaded rod 268 may have a diameter between approximately one inch and one and one-half inches. Threaded rod 268 may be formed from carbon steel, stainless steel or any other material satisfactory for use with a railway car. Various protective features such as a boot (not expressly shown) may be disposed over portions of motor 252, threaded rod 268 and/or primary linkage 262 to provide protection from water and/or other potential sources of corrosion or contamination. Various types of threads may be formed on exterior portions of threaded rod 268 and interior portions of drive nut 258 including, but not limited to, conventional ACME thread profiles with between two and five threads per inch.

Various types of conduits and/or flow lines may be used to provide high pressure air (such as 90 psi) to rotate motor 252. For embodiments such as shown in FIG. 10, first conduit 254*d* and second conduit 256*d* may extend from motor 252 to a position located adjacent an associated sidewall 30*d* shown in FIG. 15A of associated railway car 20*a*. In a similar manner, conduits 254*c* and 256*c* may extend from motor 252 to opposite side wall 30*c*.

For some applications conduits 254*c* and 254*d* may be used to supply high pressure air to rotate motor 252 in a direction which will result in moving longitudinal door assemblies 90*c* and 90*d* from their first, closed position to their second, open position. In a similar manner, air may be supplied to motor 252 from conduits 256*c* or 256*d* to move associated longitudinal door assemblies 90*c* and 90*d* from their second, open position to their first, closed position. When air is supplied from conduit 254*d*, conduit 256*d* may function as an exhaust line or discharge line. In a similar manner when air is supplied to motor 252 through conduit 256*d*, conduit 254*c* may function as an exhaust or line. Various check valves and/or control valves (not expressly shown) may also be provided to control the flow of high pressure air to an exhaust air from motor 252. For some applications motor 252 may be generally described as a high speed, low torque air motor. Such air motors may be obtain from various commercial sources.

As previously noted brackets 264*a* and 264*b* may be used to slidably support portions of primary linkage 262 adjacent to portions of center sill 52*a*. Brackets 264*a* and 264*b* also cooperate with each other to prevent rotation of hollow tube 259 when motor 252 rotates threaded rod 268. As a result, rotation of threaded rod 268 will be translated by drive nut 258 into longitudinal movement of primary linkage 262 relative to center sill 52*a*. For some applications discharge control system 250*a* may open associated discharge doors or gates by rotating motor 252 and associated threaded rod 268 clockwise. For such applications rotation of motor 252 and associated threaded rod 268 counterclockwise may result in moving discharge door assemblies 90*c* and 90*d* from their open position to their first, closed position.

Discharge control systems 250*a* (FIG. 10) and 250*b* (FIG. 11A) may also include one or more secondary portions or secondary linkage assemblies 270. For embodiments such as shown in FIGS. 10 and 11A each secondary linkage assembly 270 may be attached to primary linkage 262. Multiple secondary linkage assemblies 270 (when used) may be disposed in a generally symmetrical pattern with respect to primary linkage 262 and with respect to each other to help balance forces placed on primary linkage 262 while opening and closing longitudinal door assemblies 90*c* and 90*d*.

Each secondary linkage assembly 270 may include a pair of pivot arms 274*a* and 274*b* which extend from primary linkage 262 to engage respective longitudinal door assemblies 90*c* and 90*d*. Respective first ends 276*a* and 276*b* of each arm 274*c* and 274*d* may include a respective ball joint which may be rotatably engaged with associated socket assembly 272. Second ends 278*a* and 278*b* of each arm 274*c* and 274*d* may be rotatably engaged with associated longitudinal door assemblies 90*c* and 90*d*.

For embodiments represented by discharge control systems 250*a* (FIG. 10) and 250*b* (FIG. 11A), longitudinal movement of first portion or primary linkage 162*a* relative to center sill 52 may result in three dimensional rotation or radial pivoting of pivot arms 274*c* and 274*d* relative to secondary linkage assembly 270 during opening and closing of attached discharge door assemblies 90*c* and 90*d*.

Arms 274*c* and 274*d* of each secondary linkage assembly 270 may rotate through a compound angle oriented generally in a direction parallel to primary linkage 262 when gates 90*c* and 90*d* move from their second, open position to an over center locked position extending generally laterally from primary linkage 262 when gates 90*c* and 90*d* are in their first, closed position. Additional secondary linkage assemblies 270 (not expressly shown) may be added to allow associated hoppers to carry heavier lading. The length of pivot arms 274*c* and 274*d* may be approximately equal to this required length of travel for primary linkage 262 to open and close discharge doors 90*c* and 90*d*.

For embodiments such as shown in FIGS. 11A and 11B discharge control system 250*b* may include power source or capstan drive mechanism 282 in combination with previously described first portion or primary linkage 262 and second portion or secondary linkage 270. Pivot arms 274*a* and 274*b* may rotate through three degrees of freedom relative to associated socket assembly or carriage 272. Pivot arms 274*a* and 274*b* may be placed in an over center locked position when associated doors 90*c* and 90*d* are in their first, closed position. Various components of discharge control system 250*b* may have respective first positions corresponding generally with a first, closed position associated with longitudinal door assemblies 90*c* and 90*d* and respective second positions corresponding generally with a second, open position associated with longitudinal door assemblies 90*c* and 90*d*.

In FIG. 11A capstan drive mechanism 282 may be disposed adjacent to a first end of primary linkage 262 such as previously described with respect to discharge control system 250*a*. Various components of capstan drive mechanism 282 may be securely engaged with adjacent portions of center sill 52*a* using attachment plate 284. Various types of mechanical fasteners such as bolts, nuts and/or blind rivets may be satisfactorily used to securely engage attachment plate 284 with center sill 52*a*. Gear box 286 may be securely engaged with attachment plate 284 using similar types of mechanical fasteners.

For some applications, gear box 286 may be referred to as a miter gear box or a beveled "T" gear box. See FIG. 11B. Gear box 286 may also be referred to as a right-angle gear box since rotation of a drive shaft extending generally laterally from this gear box may be translated into rotation of a drive shaft extending generally longitudinally from gear box 286.

Longitudinal drive shaft 288 may extend from gear box 286 and may be securely engaged with one end of threaded rod 268 opposite from drive nut 258. Lateral drive shafts 290*d* and 290*c* may also extend from gear box 286. Respective capstans 292*d* and 292*c* may be disposed on the ends of respective lateral drive shafts 290*c* and 290*d* opposite from gear box 286. Capstans 292*c* and 292*d* as shown in FIG. 11A may be releasably engaged with various types of manual operating devices and may also be releasably engaged with various types of wayside drive mechanisms located exterior to an associated railway car. U.S. Published Patent Application US 2004/0112181 entitled "Railroad Hopper Car Gate Operating System" shows one example of a wayside drive system operable to rotate capstans associated with a railcar discharge control system.

Holes 293 may be formed in each capstan 292*c* and 292*d* to allow inserting a manual drive bar (not expressly shown) therethrough. Capstans 292*c* and 292*d* may also include "square" drive connections operable to be releasably engaged by a powered driver (not expressly shown) having a compatible "square" drive receptacle. Various types of tapered drives (not expressly shown) may also be inserted into capstans 292*c* and 292*d*.

Some wayside power systems may be similar to an air-powered impact wrench (not expressly shown) mounted on a small hand truck or hand cart. Hydraulic powered motors (not expressly shown) may be included in some wayside power systems to eliminate or substantially reduce potential sparks during rotation of a capstan. Sealed electrical motors may also be used to reduce potential explosive hazards associated with loading and unloading a hopper car at grain elevators. Robotic platforms may be used to properly position wayside power systems adjacent to capstans 292*c* and 292*d*. Wayside power systems may move with hopper car 20*a* after engagement with capstans 292*c* or 292*d* until unloading has been completed.

Wayside drive systems may provide large amounts of torque such as approximately 10,000 to 12,000 foot pounds required use to open and close some conventional gates or discharge doors associated with existing bottom dump hopper cars. One of the benefits of providing discharge control systems incorporating teachings of the present disclosure may be relatively low values of torque required to satisfactorily open or close associated discharge doors or gates. Applying high torque loads to a discharge control system incorporating teachings of the disclosure may damage associated primary and/or secondary linkage assemblies. Gear box 286 may also be damaged by excessive torque. A wide variety of commercially available torque limiters may be included in a capstan drive mechanism incorporating teachings of the disclosure to prevent such damage.

For example, torque limiter 294 may be included as a portion of longitudinal drive shaft 288 disposed between gear box 286 and threaded bar 268. For some applications, torque limiter 294 may be described as "load holding" such that the amount of torque placed on threaded bar 268 will remain relatively constant even though the amount of torque applied to longitudinal drive shaft 288 within gear box 286 may significantly exceed desired operating torque limits for primary linkage 262. For other applications, full disengagement torque limiters may be used. Even shear pins may be used if such use does not cause maintenance delays associated with replacement of broken shear pins.

Various types of slip mechanisms or one-way clutch mechanisms (not expressly shown) may also be provided within gear box 286 or may be provided as part of respective lateral drive shafts 290*c* and 290*d*. Such one-way clutches or slip mechanisms may be used to prevent rotation of lateral drive shaft 290*d* when lateral drive shaft 290*c* is engaged with a wayside drive system. In a similar manner, a slip clutch or one-way clutch may be provided in lateral drive shaft 290*c* to prevent rotation of 290*c* when a wayside drive system in releasably engaged with capstan 292*d*.

Various types of couplings and supporting structures 296 may be satisfactorily used to engage one end of longitudinal drive shaft 288 with threaded rod 268. Bracket 298 may also be provided as part of support plate 284 to provide support for longitudinal drive shaft 288 and threaded rod 268. As shown in FIG. 14, capstan 292*d* may be disposed adjacent to sidewall 30*d*.

As previously noted, brackets 264*a* and 264*b* may cooperate with each other to prevent rotation of hollow tube 259 during rotation of threaded rod 268. As a result, discharge control system 250*b* may open associated discharged doors 90*c* and 90*d* by rotating either capstan 292*d* or 292*c* in a first direction which may result in pushing primary linkage assembly 262 longitudinally relative to center sill 52*a* in a first direction which unlocks or opens associated discharge doors 90*c* and 90*d*. Capstan 292*c* or 292*d* may be rotated in a second direction which pulls primary linkage assembly 262 in a second direction to close associated discharge door assemblies 90*c* and 90*d*.

FIG. 11B is a schematic drawing showing one example of a miter gear box satisfactory for use with a discharge control system incorporating teachings of the disclosure. Respective beveled gears 304 may be mounted on the ends of longitudinal drive shaft 288 and lateral drive shafts 290*c* and 290*d* disposed within gear box 286. Beveled gears 304 may be engaged with each other to allow rotation of capstan 292*c* or capstan 292*d* to be translated into rotation of longitudinal drive shaft 288. The ratio of gears 304 may be 1:1:1 or may be 2:2:1 as desired. Drive shafts 288, 290*c* and 290*d* may have a nominal diameter of approximately one inch for some applications. Various mechanical stops and/or thrust bearings may also be disposed in or adjacent to gear box 286.

Discharge control systems 350, 350*a*, 350*b* and 350*c* as shown in FIGS. 12 and 13 represent further embodiments of the disclosure. For some applications, discharge control system 350 may include power source or motor 352 which may be used to rotate portions of primary linkage such as threaded rod or threaded bar 362. A plurality of secondary linkage assemblies designated 370*a* and 370*b* may be operably engaged with threaded rod 362. For some applications, rotation of threaded rod 362*a* and 362*b* may result in longitudinal movement of associated secondary linkage assemblies 370 relative to threaded rod 362 and center sill 52.

Longitudinal movement of secondary linkage assemblies 370*a* and 370*b* may result in opening and closing of associated longitudinal door assemblies 90*a* and 90*b*. For example, rotation of threaded rod 362 in a first direction may result in longitudinal movement of secondary linkage assemblies 370 in a first direction relative to center sill 52 and radial extension of associated arms 174*a* and 174*b* to move longitudinal door assemblies 90*a* and 90*b* from their second, open position to their first, closed position. Rotation of threaded rod 362 in a second direction may result in longitudinal movement of secondary linkage assemblies 370*a* and 370*b* in a second direction and radial retraction of associated arms 174*a* and 174*b* to move longitudinal door assemblies 90*a* and 90*b* from their first, closed position to their second, open position.

For some applications motor 352 of discharge control system 350 may be generally described as an air motor having air inlet 356 and air outlet 358. Motor 352 may be coupled or securely engaged with center sill 52 using attachment plate 354. Discharge control system 350 may also include gearbox 353 with a reduction gear assembly (not expressly shown) operably engaged with motor 352 and threaded rod 362. Gearbox 353 may provide desired mechanical advantage and/or speed reduction for rotation or turning of threaded rod 362. For some applications threaded couplings 360*a* and 360*b* may be used to engage gearbox 353 with respective threaded rods 362*a* and 362*b*.

In some embodiments, a detached motor (not expressly shown) may drive gearbox 353. A detached motor may operably engage a drive shaft or capstan (See FIG. 14) extending from gearbox 353 to rotate primary linkage 362. In other embodiments, gearbox 353 may receive a drive shaft (not expressly shown) extending from the detached motor. In further embodiments, a manual actuator may be used to drive gearbox 353 to opening and close door assemblies 90*a* and 90*b*.

For some applications each secondary linkage assembly 370 may include respective threaded bosses or drive nuts 374*a* and 374*b*. Each threaded boss 374*a* and 374*b* may include respective internal threads (not expressly shown) engaged with respective threads 364*a* and 364*b* formed on exterior portions of threaded rods 362*a* and 362*b*. Cooperation between threads 364*a* and 364*b* and respective threaded bosses or drive nuts 374*a* and 374*b* may be used to convert rotational movement of threaded rods 362*a* and 362*b* into longitudinal movement of associated second linkage assemblies 370 relative to threaded rod 362 and center sill 52.

For some applications primary linkage 362 may be formed in two sections represented by primary linkage subsection or bar 362*a* and primary linkage subsection or bar 362*b*. Threaded bars 362*a* and 362*b* may be coupled to motor 352 via gearbox 353 to allow threaded bars 362*a* and 362*b* rotate in the same direction. Threads 364*a* may be formed on bar 362*a* in one direction. Threads 364*b* formed on bar 362*b* may be formed in a reverse direction. Reverse threading on bars 362*a* and 362*b* may cause each threaded boss 374*a* and 374*b* to move longitudinally in opposite directions. By rotating threaded rods 362*a* and 362*b* in a common direction, each threaded boss 374*a* and 374*b* may be driven longitudinally in opposite directions.

In one embodiment, threaded boss 374*a* and threaded boss 374*b* may be driven towards each other to cause arms 174*a* and 174*b* to move longitudinal door assemblies 90*a* and 90*b* to a first, closed position. The relationship and interaction between each threaded bosses 374*a* and 374*b* with respective threaded bars 362*a* and 362*b* may be described as similar to an ACME screw jack. Similarly to operating mechanism 150, operating mechanism 350 may include over center locking position for arms 174*a* and 174*b*.

Discharge control system 350 as shown in FIG. 12 may be used to open and close longitudinal discharge door assemblies 90*a* and 90*b* associated with railway car 20. The number of secondary linkage assemblies 370 may be increased to accommodate the weight associated with relatively long discharge doors used on coal cars. One of the advantages associated with using discharge control system 350 as compared with discharge control systems 150 and 150*a* is the ability of motor 352 to incrementally limit opening of discharge door assemblies 90*a* and 90*b*. For example, motor 352 may rotate threaded rods 362*a* and 362*b* in relatively small increments to open longitudinal discharge doors 90*a* and 90*b* in correspondingly small increments to control the discharge of lading therefrom.

For some applications motor 352 may rotate primary linkage or bar 362 in a first direction which results in movement of each threaded boss 374*a* and 374*b* in a first longitudinal direction away from gearbox 353. This movement results in moving associated longitudinal door assemblies from their second, open position to their first, closed position such as shown in FIG. 12. Rotation of threaded bar 362 may result in pulling or longitudinal movement of each threaded boss 374*a* and 374*b* in a longitudinal direction towards gearbox 353. Such longitudinal movement of threaded bosses 374*a* and 374*b* results in longitudinal door assemblies 90*a* and 90*b* moving from their first, closed position to their second, open position.

One of the benefits associated with discharge control system 350 is the ability of motor 352 to stop the rotation of primary linkage or bar 362 at any desired position and to securely hold longitudinal door assemblies 90*a* and 90*b* in a corresponding intermittent position between open and closed (not expressly shown). For embodiments represented by discharge control systems 350 and 350*a* motor 352 may push or move associated secondary linkage 370*a* and 370*b* longitudinally away from gearbox 353. Motor 352 may rotate primary linkage or threaded bar 362 in an opposite direction to pull or move associated secondary linkage assemblies 370*a* and 370*b* in a second longitudinal direction towards gearbox 353.

FIG. 13 is a schematic drawing showing an isometric view with portions broken away of a discharge control system which may be satisfactorily used to unload grain and other types of bulk lading from a covered hopper car. For the embodiment shown in FIG. 13, center sill 351 may have the same configuration as previously described with respect to railway car 20. For other applications center sill 52*a* as shown in FIGS. 15A and 15B may be used with a covered hopper car or a grain car.

For embodiments such as shown in FIG. 12, discharge door assemblies 90*a* and 90*b* along with primary linkage or bar 362 may be disposed generally longitudinally relative to center sill 351. For embodiments such as shown in FIG. 13 a plurality of discharge control systems 350*a*, 350*b* and 350*c* along with associated discharge door assemblies 380*a* and 380*b* and respective primary linkages 362 may extend generally normal to or perpendicular with respect to center sill 351. For embodiments each discharge control system 350*a*, 350*b* and 350*c* may include a pair of secondary linkage assemblies 370*a* and 370*b*. For other applications (not expressly shown) discharge control system 350*a*, 350*b* and 350*c* may include only one secondary linkage assembly 370.

Dimensions of lateral discharge door assemblies 390*a* and 390*b* may be substantially reduced as compared with longitudinal discharge door assemblies 90*a* and 90*b*. Therefore, for some applications only a single secondary linkage 370 may be required to satisfactorily open and close lateral discharge door assemblies 390*a* and 390*b*. Piano type hinges 392*a* and 392*b* may sometimes be used to rotatably engage discharge door assemblies 390*a* and 390*b* with adjacent portions of a railway car underframe. Piano hinges 392*a* and 392*b* may be used with a hopper car carrying bulk materials such as grain or fine particles of dry powder. One of the benefits associated with the use of discharge control system 350*a*, 350*b* and 350*c* with a grain car is the ability of each motor 352 to be able to provide finite control for the opening of associated lateral door assemblies 390*a* and 390*b* during unloading of the grain car.

Technical benefits of the disclosure includes the ability of discharge control system 350 to open and close discharge doors 90*a* and 90*b* and discharge control systems 350*a*, 350*b* and 350*c* to open and close associated discharge doors 390*a* and 390*b* in discrete increments. For example, motor 352 may rotate primary linkage 362 as required to open the associated discharge doors approximately one-half.

For some applications cooperation between gearbox 353 and ACME screw jack type connections formed between each threaded boss 374*a* and 374*b* with respective threaded bars 362*a* and 362*b* may substantially reduce the amount of energy required to open and/or close associated discharge doors 90*a* and 90*b* or 390*a* and 390*b*. As a result relatively small motor 352 may be satisfactorily used to open and close discharge doors associated with a grain hopper car.

Pneumatically driven motors or air motors have frequently been used to open and close discharge doors or gates associated with closed hopper cars and/or grain hopper cars. The air driven motors associated with such hopper cars often required the use of an air supply hose with a nominal diameter of approximately one and one-quarter inches. Such air hoses typically supplied a relatively high volume of air at approximately ninety pounds per square inch (90 psi) to generate approximately twelve thousand foot pounds of torque. The relatively high amount of torque and the relatively large volume of 90 psi air was required to satisfactorily open and close many of the discharge doors or gates previously used with grain cars and other types of closed hopper cars.

As a result of the increased mechanical advantage provided by gearbox 353 and the ACME screw jack type connections formed between threaded bosses 374*a* and 374*b* and respective threaded bars 362*a* and 362*b*, each motor 352 may be required to only provide approximately 9,000 foot pounds of torque to satisfactorily open and close associated lateral discharge doors 390*a* and 390*b*. As a result an air hose with a normal diameter of approximately one-quarter of an inch or one-half of an inch may be satisfactorily used to provide the desired volume of 90 psi air to inlet 365.

Railway car 20*a* as shown in FIGS. 14, 15A and 15B may be generally described as a closed hopper car or a covered hopper car. For embodiments such as shown in FIGS. 14A, 15A and 15B, railway car 20*a* may also be referred to as a "grain car." Typical dimensions for a grain car may include a length between truck centers of approximately fifty-seven (57) feet and five (5) inches; a length of sixty-seven (67) feet and four (4) inches between over strikers and a length of seventy-one (71) feet and five (5) inches between pulling faces.

Conventional hopper cars having such dimensions may also have four individual hoppers with respective discharge openings and discharge gates or doors associated with each hopper. Three cross ridges and three associated dividers are typically used to form four hoppers. Cross ridges are generally required to feed or direct the flow of lading into respective discharge openings associated with each hopper. Discharge gates associated with conventional grain hopper cars are often relatively small such as approximately thirty inches in length. The carrying capacity for a covered hopper car with four hoppers and the previously noted length dimensions may be approximately 6,351 cubic feet. Such covered hopper cars may also be referred to as "jumbo" grain cars.

As a result of incorporating various teachings of the disclosure, railway car 20*a* may have similar length dimensions as previously noted with an increased capacity of approximately 6,717 cubic feet. The increased capacity may result from reducing the number of cross ridges and dividers associated with the four individual hoppers to only one cross ridge and one associated divider required to form only two hoppers in railway car 20*a*.

Railway car 20*a* incorporating teachings of the disclosure may include a pair of sidewall assemblies 30*c* and 30*d*, bottom slope sheet assemblies 40*c* and 40*d* and sloped end wall assemblies 80*c* and 80*d* mounted on railway car underframe 50*a*. Roof assembly 88 may be disposed on sidewall assemblies 40*c* and 40*d* and end wall assemblies 80*c* and 80*d* opposite from railway car underframe 50*a*. Manway opening or personnel access 89 may be provided in roof assembly 88.

For some applications, railway car 20*a* may be formed with only two hoppers. The first hopper may extend between sloped end wall assembly 80*c* (A end of railway car 20*a*) and cross ridge assembly 280. A second hopper may extend between cross ridge 280 and sloped end wall assembly 80*d* (B end of railway car 20*a*). The first hopper may be further defined by portions of sidewall assemblies 30*c* and 30*d* and portions of bottom sloped sheet assemblies 40*c* and 40*d* disposed between end wall assembly 80*c* and cross ridge 280. In a similar manner the second hopper may be further defined in part by portions of sidewall assemblies 30*c* and 30*d* and portions of bottom sloped sheet assemblies 40*c* and 40*d* disposed between cross ridge 280 and sloped end wall assembly 80*d*.

Divider 281 may also be disposed with railway car 20*a* extending from cross ridge 280 to further define the first hopper and the second hopper. See FIG. 15A. Slope sheet 283 may extend from the end of divider 281 at the end of the second hopper opposite from end wall assembly 80*d*. See FIG. 15A. A similar slope sheet (not expressly shown) may extend from the end divider 281 at the end of the first hopper opposite from end wall assembly 80*c*. The slope sheets at the end of divider 281 may also contact adjacent portions of cross ridge 280.

End wall assemblies 80*c* and 80*d* may have the same overall configuration and dimensions. End wall assembly 80*c* as shown in FIG. 15B may be similar to end wall assembly 80*d*. End wall assembly 80*c* may include sloped portion 82*c* and generally vertical portion 84*c*. The angle of sloped portion 82*c* (and 82*d* of end wall assembly 80*d*) may be selected to aid in discharging grain or other lading from the associated hopper. End wall assemblies 80*c* and 80*d* may be formed from metal sheets similar to metal sheets or other materials used to form sidewall assemblies 30*c* and 30*d*.

Railway car underframe 50*a* may include center sill 52*a*, side sills 54*c* and 54*d*, body bolsters, striker plates and other components associated with a grain car or covered hopper car. See FIGS. 14, 15A and 15C. A pair of railway trucks 22 and 24 may be disposed proximate opposite ends of center sill 52*a*. For embodiments of the disclosure represented by railway car 20*a*, center sill 52*a* may have a generally square cross section. Lower portions of center sill 52*a* may include a longitudinal slot. Generally triangular shaped dome assembly or cover 56*a* may be disposed on portions of center sill 52*a* located within each hopper.

Sidewall assemblies 30*c* and 30*d*, having approximately the same overall configuration and dimensions, may extend longitudinally between sloped end wall assemblies 80*c* and 80*d*. Sidewall assemblies 30*c* and 30*d* may have generally curved configuration extending outwardly from the interior of railway car 20*a*. Sidewall assemblies 30*c* and 30*d* may also include respective top chords 32*c* and 32*d*. Top chords 32*c* and 32*d* extend generally parallel with each other between sloped and wall assemblies 80*c* and 80*d*.

A plurality of metal sheets 36 may be securely attached with interior portions of respective top chords 32*c* and 32*d* and side sills 54*c* and 54*d*. For some applications side sills 54*c* and 54*d* may be elevated approximately ten (10) inches above the top of shear plates which rest on center sill 52*a*. Supporting structures (not expressly shown) may be provided to securely hold side sills 54*c* and 54*d* in an elevated position to allow access to various components of an associated discharge control system such as capstans 292*c* and 292*d* and/or vibrator brackets 316. Metal sheets 36*a* may have a generally curved or arcuate configuration extending outward from the interior of railway car 20*a*. The generally curved configuration of metal sheets 36*a* increases the cubic capacity of railway car 20*a*.

A pair of bottom slope sheet assemblies 40*c* may extend from sidewall assembly 30*c* with one end of cross ridge 280 disposed therebetween. A pair of bottom slope sheets 40*d* may extend from sidewall assembly 40*d* with an opposite end of cross ridge 280 disposed therebetween. Bottom slope sheet assemblies 40*c* and 40*d* may have approximately the same overall dimensions and configurations. Bottom slope sheet assemblies 40*c* and 40*d* may be formed from a metal sheet attached with interior portions of respective side sill assemblies 54*c* and 54*d* and/or end wall assemblies 80*c* and 80*d*. Bottom slope sheets 40*c* and 40*d* preferably extend downwardly and inwardly with respect to center sill 52*a*.

Each hopper may include respective portions of bottom slope sheets 40*c* and 40*d*. Respective vibrator brackets 316 may also be provided to accommodate attachment of a vibrator with the respective slope sheets 40*c* and 40*d*. Bottom slope sheets 40*c* and 40*d* may extend downwardly and inwardly at an angle from respective side sills 54*c* and 54*d* to a location proximate a bottom clearance for associated railway car 20*a*. American Association of Railroads (AAR) specifications and operating envelope define applicable clearance for railway car 20*a*. See dotted line 41 in FIGS. 15A and 15B.

For some embodiments, bottom slope sheets 40*c* and 40*d* may extend at an angle of approximately forty-five degrees relative to respective side sills 54*c* and 54*d*. The angle of bottom slope sheets 40*c* and 40*d* may be increased to aid in discharge of lading therefrom. Edge 45 of each slope sheet 40*c* and 40*d* opposite from respective side sills 54*c* and 54*d* cooperate to define associated discharge openings 26*c* and 26*d*.

Longitudinal door assemblies 90*c* and 90*d* may be hinged proximate a lower portion of center sill 52*a* opposite from dome 56*a*. Longitudinal door assemblies 90*c* and 90*d* may be formed with overall dimensions and configurations compatible with respective bottom slope sheets 40*c* and 40*d* and associated longitudinal discharge openings 26*c* and 26*d*. Various types of hinges such as previously described with respect to railway car 20 may also be satisfactorily used to engage respective door assemblies 90*c* and 90*d* with center sill 52*a* to accommodate pivotal or rotational movement of door assemblies 90*c* and 90*d* between respective open and closed positions. Hinge assembly 273 is shown in FIGS. 10 and 11A.

Respective pairs of discharge door assemblies 90*c* and 90*d* formed in accordance with teachings of the disclosure may extend between cross ridge 280 and associated railway trucks 22 and 24. For some applications the length of longitudinal discharge openings 26*c* and 26*d* and door assemblies 90*c* and 90*d* may be approximately twenty-two feet. Each door assembly 90*c* and 90*d* may be formed from metal sheets having similar thickness and other characteristics associated with metal sheets 36*a* and 46*a*.

For some embodiments a railway car may be formed with a first discharge control system operating one pair of door assemblies and a second discharge control system operating a second pair of door assemblies. Such railway cars may include respective operating cylinders, respective motors or respective capstan drive mechanisms disposed proximate a midpoint of each railway car. For example, grain car 20*a* as shown in FIGS. 14, 15A and 15C may have two separate discharge control systems 250*b* as shown in FIG. 11A.

respective capstan drive mechanisms 282 may be disposed adjacent to each other below cross ridge 280. Respective capstans 292*d* for each discharge control system 250*b* are shown in FIG. 14.

Other power sources such as two air cylinders or two air motors may also be disposed beneath cross ridge 280 to operate respective discharge control systems. Capstan drive mechanisms or motors in combination with a threaded bar allow variable opening of associated discharge doors. Air cylinders or hydraulic cylinders typically accommodate either fully closed or fully open with no incremental movement or associated discharge doors Although the disclosure and its advantages have been described in detail, it should be understood that various changes, substitutions and alternations can be made herein without departing from the spirit and scope of the disclosure as defined by the following claims.

What is claimed is:

1. A system comprising:

a railway car having an underframe and at least one hopper for transporting lading;

at least one discharge opening for each hopper;

a respective door assembly disposed adjacent to each associated discharge opening, the respective door assembly including a door;

a common linkage operable to move each respective door assembly between a first, closed position and a second, open position by pulling the door of the respective door assembly from the first, closed position to the second, open position in response to the common linkage moving in a first direction and pushing the door of the respective door assembly from the second, open position to the first, closed position in response to the common linkage moving in a second direction; and a power source disposed below the underframe and coupled to the common linkage, the power source operable to reciprocate the common linkage in the first direction and the second direction.

2. The system of claim 1, wherein the railway car comprises a closed hopper car.

3. The system of claim 1, wherein the power source comprises a hydraulic cylinder.

4. The system of claim 1, wherein the power source comprises a hydraulic cylinder, the hydraulic cylinder comprising:

a piston;

a rod extending from the piston; and the rod comprising a clevis joint, wherein the power source is coupled to the common linkage with the clevis joint.

5. The system of claim 1, further comprising a hot shoe mechanism disposed on a side of the rail car, the hot shoe mechanism configured to activate the power source to reciprocate the common linkage when the hot shoe engages an electrical contact external to the system and receives an electrical signal from the electrical contact.

6. The system of claim 1 further comprising:

the underframe including a center sill which defines in part a longitudinal axis of the railway car;

each discharge opening formed proximate a lower portion of the associated hopper;

each respective door assembly engaged with a portion of the center sill adjacent to the associated discharge opening;

each door assembly operable for movement between the first, closed position and the second, open position;

a discharge control system operable to move each door assembly between the respective first, closed position and the respective second, open position; and the discharge control system including the common linkage defined in part by a beam slidably engaged with the center sill and operable to move generally in the first direction and the second direction relative to the center sill.

7. The system of claim 6, wherein the discharge control system includes at least one portion extending from the common linkage, wherein each respective door assembly is operably engaged with at least one of the at least one portion of the discharge control system, and wherein the at least one portion is operable to pull the door of the respective door assembly from the first, closed position to the second, open position in response to the common linkage moving in the first direction and operable to push the door of the respective door assembly from the second, open position to the first, closed position in response to the common linkage moving in the second direction.

8. The system of claim 7, wherein the at least one portion of the discharge control system further comprises a pair of pivot arms extending from the common linkage.

9. The system of claim 7, wherein the at least one portion of the discharge control system further comprises at least two pairs of pivot arms extending from the common linkage.

10. The system of claim 6, further comprising the beam operable to slide longitudinally relative to the center sill in the first direction and the second direction.

11. A system comprising:

a hopper car having an underframe and at least one hopper for transporting lading;

the underframe including a center sill with a pair of side sills disposed on opposite sides thereof;

the center sill defining in part a longitudinal axis of the railway car;

at least one discharge opening formed proximate to a lower portion of each respective hopper;

a respective door assembly engaged with a portion of the center sill adjacent to each respective discharge opening, the respective door assembly including a door;

each respective door assembly operable to move between a first, closed position and a second, open position relative to the respective discharge opening;

a discharge control system operable to move each respective door assembly between the first, closed position and the second, open position by pulling the door of the respective door assembly from the first, closed position to the second, open position in response to a first portion of the discharge control system moving in a first direction and pushing the door of the respective door assembly from the second, open position to the first, closed position in response to the first portion of the discharge control system moving in a second direction;

the first portion of the discharge control system slidably engaged with the center sill and operable to move generally longitudinally in the first direction and the second direction relative to the center sill to move each respective door assembly between the first, closed position and the second, open position; and a power source disposed below the underframe and operable to reciprocate the first portion of the discharge control system in the first direction and the second direction.

12. The system of claim 11, the power source comprising a hydraulic cylinder.

13. The system of claim 12, further comprising:

a pair of conduits extending from the hydraulic cylinder to one side of the hopper car and a pair of conduits extending to a second side of the hopper car; and the conduits operable to supply high pressure fluid to reciprocate a rod extending from the hydraulic cylinder.

14. The system of claim 13, further comprising:

one of the conduits operable to provide fluid to extend the rod away from the hydraulic cylinder; and another of the conduits operable to provide fluid to retract the rod toward the hydraulic cylinder.

15. The system of claim 12, wherein the hydraulic cylinder comprises:

a piston;

a rod extending from the piston; and the rod comprising a clevis joint, wherein the power source is coupled to the first portion of the discharge control system with the clevis joint.

16. The system of claim 11, wherein the first portion of the discharge control system is defined in part by a beam.

17. The system of claim 11 further comprising a hot shoe mechanism disposed on a side of the rail car, the hot shoe mechanism configured to activate the power source to reciprocate the first portion when the hot shoe engages an electrical contact external to the system and receives an electrical signal from the electrical contact.

18. A system comprising:

a hopper car having an underframe and a first hopper and a second hopper for transporting lading;

the underframe including a center sill with a pair of side sills disposed on opposite sides thereof;

the center sill defining in part a longitudinal axis of the railway car;

a respective pair of discharge openings disposed proximate a lower portion of each respective hopper;

each discharge opening extending generally parallel with the center sill;

a respective pair of door assemblies engaged with a portion of the center sill adjacent to one of the discharge openings of each respective hopper;

each door assembly operable to move between a first, closed position and a second, open position relative to the respective discharge opening;

a first discharge control system engaged with the center sill and operable to move a first respective door assembly between the first, closed position and the second, open position by pulling a door of the first respective door assembly from the first, closed position to the second, open position in response to a first portion of the first discharge control system moving in a first direction and pushing the door of the first respective door assembly from the second, open position to the first, closed position in response to the first portion of the first discharge control system moving in a second direction;

a second discharge control system engaged with the center sill and operable to move a second respective door assembly between the first, closed position and the second, open position by pulling a door of the second respective door assembly from the first, closed position to the second, open position in response to a first portion of the second discharge control system moving in a third direction and pushing the door of the door assembly from the second, open position to the first, closed position in response to the first portion of the second discharge control system moving in a fourth direction;

the first discharge control system comprising a first power source and the second discharge control system comprising a second power source, the first power source and the second power source disposed below the underframe and proximate to a central portion of the underframe;

the first power source comprising a first hydraulic cylinder; and the second power source comprising a second hydraulic cylinder.

19. The system of claim 18, further comprising:

the first portion of the first discharge control system including a first primary linkage that is slidably engaged with the center sill and operable to move longitudinally in the first direction and the second direction relative to the center sill;

the first portion of the second discharge control system including a second primary linkage that is slidably engaged with the center sill and operable to move longitudinally in the third direction and the fourth direction relative to the center sill;

a second portion of each discharge control system including a respective secondary linkage assembly having a pair of pivot arms extending from respective sides of the center sill; and the door of each door assembly operably engaged with at least one pivot arm of the respective discharge control system to move the respective door assembly between the first, closed position and the second, open position, wherein the at least one pivot arm of the first discharge control system operably engaged with the door of the first respective door assembly is operable to pull the door of the first respective door assembly from the first, closed position to the second, open position in response to the first primary linkage moving in the first direction and operable to push the door of the first respective door assembly from the second, open position to the first, closed position in response to the first primary linkage moving in the second direction, and wherein the at least one pivot arm of the second discharge control system operably engaged with the door of the second respective door assembly is operable to pull the door of the second respective door assembly from the first, closed position to the second, open position in response to the second primary linkage moving in the third direction and operable to push the door of the second respective door assembly from the second, open position to the first, closed position in response to the second primary linkage moving in the fourth direction.

20. The system of claim 19, wherein each respective first portion is defined in part by a beam.

21. The system of claim 18 wherein the hopper car is operable to carry lading selected from the group consisting of corn condensed distillers solubles (CDS), corn distillers dried grains/solubles (DDGS) and wet distillers grain with solubles (WDGS).

22. The system of claim 18, further comprising:

the underframe having a generally rectangular configuration defined in part by the center sill and a pair of side sills spaced laterally from each other with the center sill disposed therebetween and extending in a generally longitudinal direction;

the respective pair of discharge openings formed on opposite sides of the center sill with each discharge opening extending in the generally longitudinal direction relative to the center sill;

each respective door assembly mounted on the center sill adjacent to each discharge opening to control the flow of lading from the hopper;

the first discharge control system attached to the center sill and operable to move a first primary linkage in the first direction and the second direction, the first primary linkage disposed adjacent to the center sill;

the second discharge control system attached to the center sill and operable to move a second primary linkage in the third direction and the fourth direction, the second primary linkage disposed adjacent to the center sill;

at least one secondary linkage assembly extending from each respective primary linkage and engaged with the door of a respective door assembly; and each secondary linkage assembly operable to move the respective door assembly between the first, closed position and the second, open position by pulling the door of the respective door assembly from the first, closed position to the second, open position in response to the respective primary linkage moving in a respective one of the first direction and the third direction and pushing the door of the respective door assembly from the second, open position to the first, closed position in response to the respective primary linkage moving in a respective one of the second direction and the fourth direction.

23. The system of claim 22, wherein each respective primary linkage is defined in part by a beam slidably engaged with the center sill and operable to move generally relative to the center sill in the first direction and the second direction, wherein the first direction is the same as the third direction, and wherein the second direction is the same as the fourth direction.

24. The system of claim 18, further comprising:

the first discharge control system comprising a first primary linkage operable to move a first one of the respective door assemblies between a first, closed position and a second, open position by pulling the door of the first one of the respective door assemblies from the first, closed position to the second, open position in response to the first primary linkage moving in the first direction and pushing the door of the first one of the respective door assemblies from the second, open position to the first, closed position in response to the first primary linkage moving in the second direction;

the second discharge control system comprising a second primary linkage operable to move a second one of the respective door assemblies between a first, closed position and a second, open position by pulling the door of the second one of the respective door assemblies from the first, closed position to the second, open position in response to the second primary linkage moving in the third direction and pushing the door of the second one of the respective door assemblies from the second, open position to the first, closed position in response to the second primary linkage moving in the fourth direction;

the first power source coupled to the first primary linkage and operable to reciprocate the first primary linkage in the first direction and the second direction; and the second power source coupled to the second primary linkage and operable to reciprocate the second primary linkage in the third direction and the fourth direction.

25. The system of claim 24, wherein the first primary linkage and the second primary linkage are each defined in part by a respective beam slidably engaged with the center sill and operable to move generally relative to the center sill in the first direction and the second direction, wherein the first direction is the same as the third direction, and wherein the second direction is the same as the fourth direction.

26. The system of claim 18, the first hydraulic cylinder comprising:

a first piston;

a first rod extending from the first piston;

the first rod comprising a first clevis joint, wherein the first power source is coupled to the first discharge control system with the first clevis joint; and the second hydraulic cylinder comprising:

a second piston;

a second rod extending from the second piston; and the second rod comprising a second clevis joint, wherein the second power source is coupled to the second discharge control system with the second clevis joint.

27. The system of claim 18, further comprising a hot shoe mechanism disposed on a side of the rail car, the hot shoe mechanism configured to activate one or more of the first power source and the second power source to reciprocate the respective primary linkage when the hot shoe engages an electrical contact external to the system and receives an electrical signal from the electrical contact.

* * * * *